US011694532B2

(12) United States Patent
Nagashima

(10) Patent No.: US 11,694,532 B2
(45) Date of Patent: Jul. 4, 2023

(54) FIRE ALARM EQUIPMENT

(71) Applicant: HOCHIKI CORPORATION, Tokyo (JP)

(72) Inventor: Tetsuya Nagashima, Tokyo (JP)

(73) Assignee: HOCHIKI CORPORATION, Tokyo (JP)

( * ) Notice: Subject to any disclaimer, the term of this patent is extended or adjusted under 35 U.S.C. 154(b) by 0 days.

(21) Appl. No.: 17/383,073

(22) Filed: Jul. 22, 2021

(65) Prior Publication Data

US 2021/0350684 A1 Nov. 11, 2021

Related U.S. Application Data

(63) Continuation of application No. PCT/JP2020/005950, filed on Feb. 17, 2020.

(30) Foreign Application Priority Data

Mar. 29, 2019 (JP) ..... 2019-065672

(51) Int. Cl.
*G08B 17/107* (2006.01)
*G08B 17/117* (2006.01)

(52) U.S. Cl.
CPC ..... *G08B 17/107* (2013.01); *G08B 17/117* (2013.01)

(58) Field of Classification Search
CPC ..... G08B 17/107; G08B 17/117
See application file for complete search history.

(56) References Cited

U.S. PATENT DOCUMENTS 5,225,810 A * 7/1993 Inoue ..... G01S 17/10 340/630
5,691,704 A 11/1997 Wong
(Continued)

FOREIGN PATENT DOCUMENTS

CN 1209896 3/1999
CN 102314743 1/2012
(Continued)

OTHER PUBLICATIONS

International Search Report dated Mar. 10, 2020 in International (PCT) Application No. PCT/JP2020/005950.
(Continued)

*Primary Examiner* — Hoi C Lau
(74) *Attorney, Agent, or Firm* — Wenderoth, Lind & Ponack, L.L.P.

(57) ABSTRACT

A photoelectric smoke detector (14) connected to a signal line (12-1) drawn into a warning area from a receiver (10) transmits a fire signal including identification information of smoke caused in detection zones Z1 and Z2. In the detection zones, a sensor (18) for sensing a change of physical phenomenon other than smoke involved in fire is provided, and the sensor (18) is connected to the signal line (12-1) via a relay device (16). The sensor (18) is at least one of a $CO_2$ sensor, a CO sensor, a fire sensor, and a heat sensor. A fire alarm control unit (48) of the receiver (10) causes an alarm to be given, when determining the identification information of the smoke by the photoelectric smoke detector (14) and a sensing value by at least one of the $CO_2$ sensor, the CO sensor, the fire sensor, and the heat sensor.

6 Claims, 11 Drawing Sheets

(56) References Cited

U.S. PATENT DOCUMENTS

| | | | | |
|---|---|---|---|---|
| 5,767,776 | A | 6/1998 | Wong | |
| 6,515,283 | B1 * | 2/2003 | Castleman | G08B 17/12 340/578 |
| 6,518,574 | B1 * | 2/2003 | Castleman | G08B 29/24 250/339.05 |
| 2005/0173638 | A1 * | 8/2005 | Powell | G01N 21/0303 250/341.1 |
| 2005/0200492 | A1 * | 9/2005 | Woodard | G08B 25/08 340/539.1 |
| 2006/0250260 | A1 * | 11/2006 | Albert | G08B 21/0211 340/628 |
| 2006/0261967 | A1 * | 11/2006 | Marman | G08B 29/26 340/630 |
| 2008/0246623 | A1 | 10/2008 | Nagashima | |
| 2008/0291037 | A1 * | 11/2008 | Lax | G08B 17/10 340/628 |
| 2009/0315722 | A1 * | 12/2009 | Hou | G01J 5/025 340/578 |
| 2010/0081957 | A1 * | 4/2010 | Hyde | A61M 15/02 600/300 |
| 2010/0288929 | A1 * | 11/2010 | Dittmer | G01J 5/0896 250/339.15 |
| 2012/0205920 | A1 * | 8/2012 | Gold | E05C 9/00 292/138 |
| 2015/0226585 | A1 * | 8/2015 | Yang | H04R 1/04 73/431 |
| 2015/0310732 | A1 * | 10/2015 | Piccolo, III | G08B 29/145 340/515 |
| 2018/0073982 | A1 * | 3/2018 | Ebata | G01N 21/53 |
| 2018/0114430 | A1 * | 4/2018 | Westmacott | G08B 29/183 |
| 2018/0190101 | A1 * | 7/2018 | Dixon | G08B 17/10 |
| 2018/0266680 | A1 * | 9/2018 | Arabi | G05B 23/024 |
| 2018/0308475 | A1 * | 10/2018 | Locke | G06F 40/279 |
| 2019/0109932 | A1 * | 4/2019 | Higgins | G08B 15/004 |
| 2020/0115880 | A1 * | 4/2020 | Bertini | G01K 11/06 |
| 2020/0116686 | A1 * | 4/2020 | Bertini | G01N 33/0006 |
| 2022/0120672 | A1 * | 4/2022 | Uchida | G01N 21/31 |

FOREIGN PATENT DOCUMENTS

| | | |
|---|---|---|
| EP | 0 877 995 | 11/1998 |
| EP | 2 402 920 | 1/2012 |
| EP | 3 107 079 | 12/2016 |
| JP | 1-313071 | 12/1989 |
| JP | 08-315270 | 11/1996 |
| JP | 2000-504132 | 4/2000 |
| JP | 2003-190313 | 7/2003 |
| JP | 2004-325211 | 11/2004 |
| JP | 2004-341661 | 12/2004 |
| JP | 2007-265353 | 10/2007 |
| JP | 2008-004033 | 1/2008 |
| JP | 2008-225857 | 9/2008 |
| JP | 2009-008511 | 1/2009 |
| JP | 2010-114632 | 5/2010 |
| JP | 2012-014330 | 1/2012 |
| JP | 2015-170080 | 9/2015 |
| WO | 97/27571 | 7/1997 |

OTHER PUBLICATIONS

Extended European Search Report dated Dec. 23, 2022 in corresponding European Patent Application No. 20783125.6, 9 pages.

Office Action dated Jul. 5, 2022 in corresponding Japanese Patent Application No. 2021-511192, with English translation, 27 pages.

* cited by examiner

[FIG. 1]
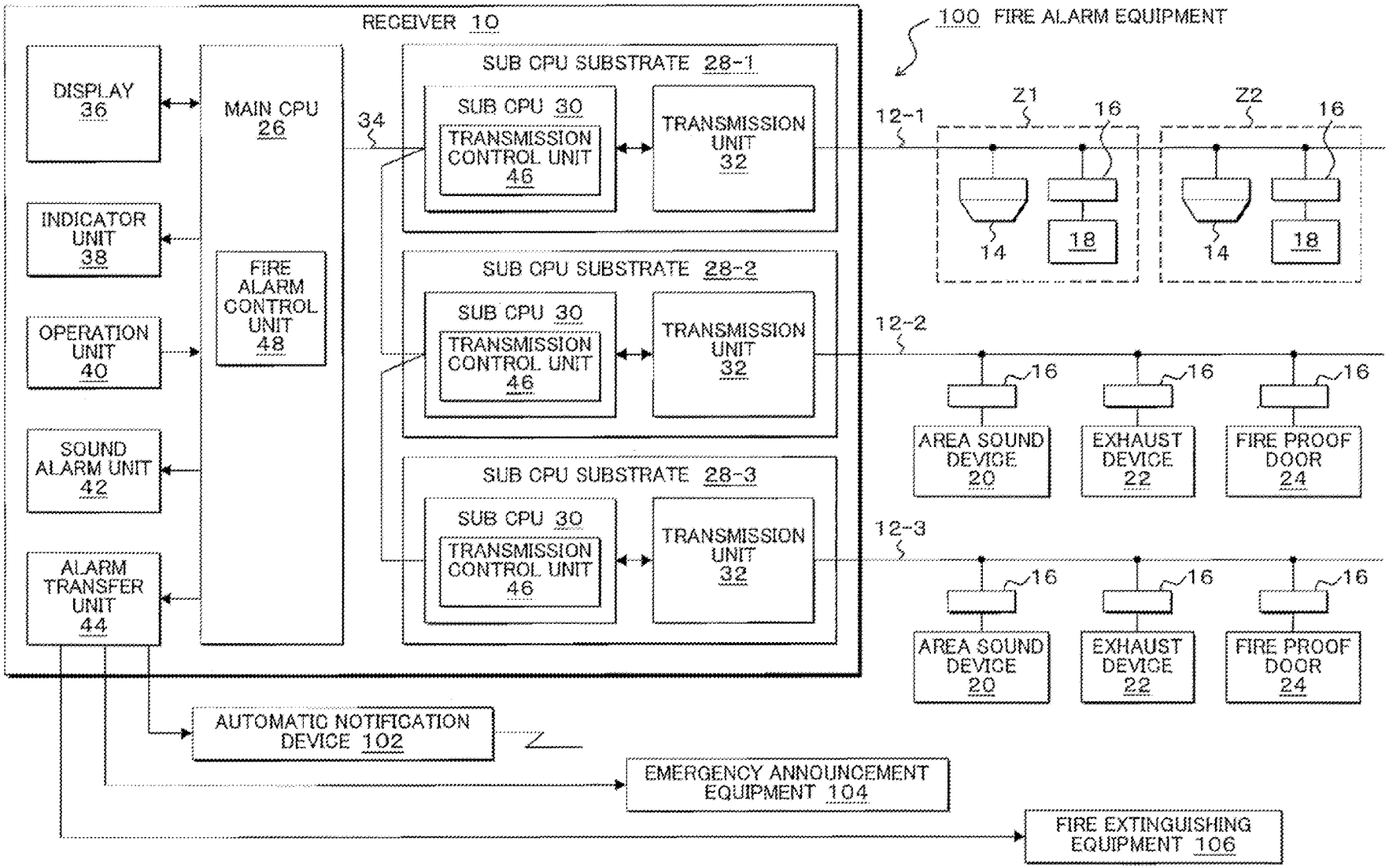

[FIG. 2]
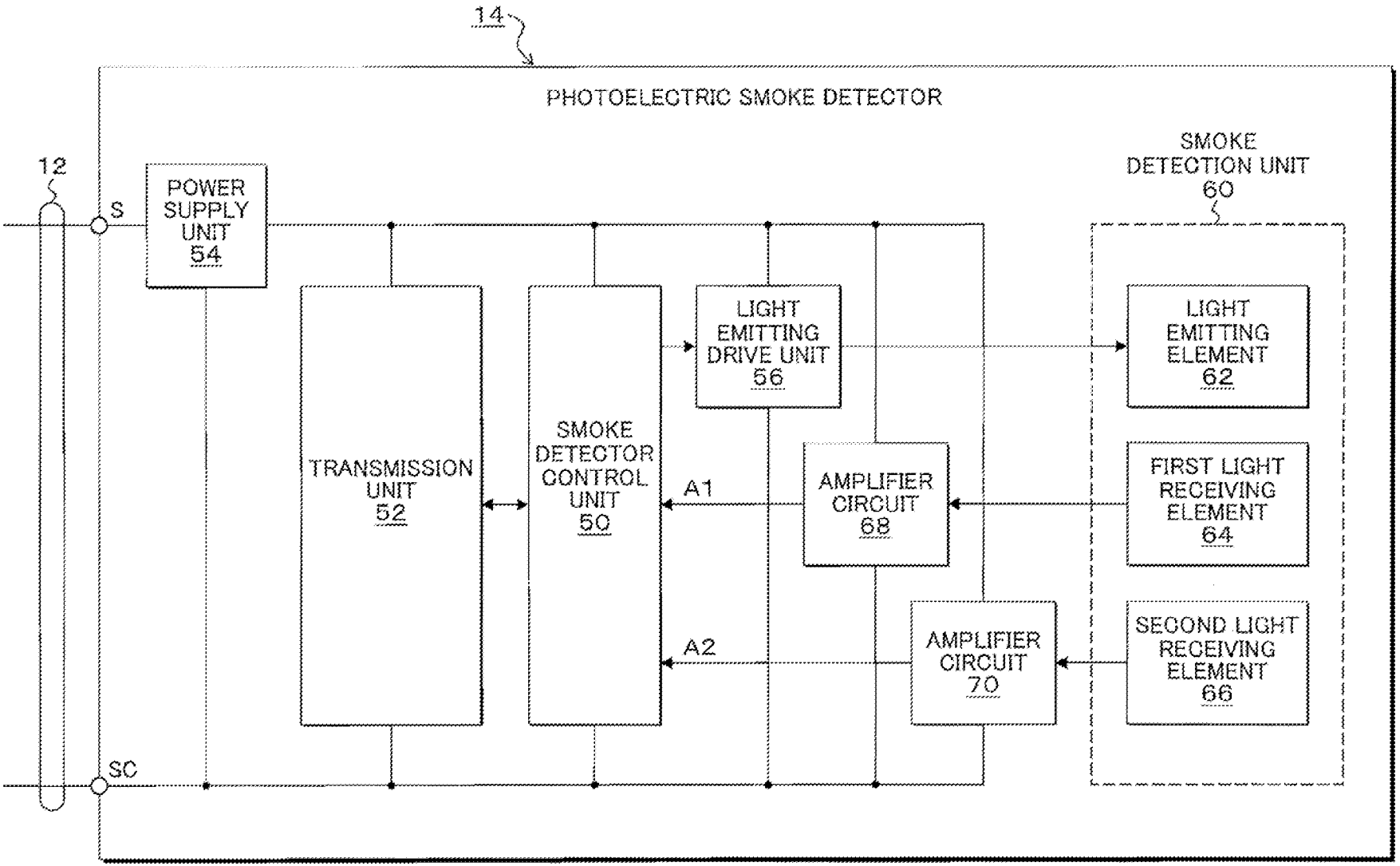

[FIG. 3]
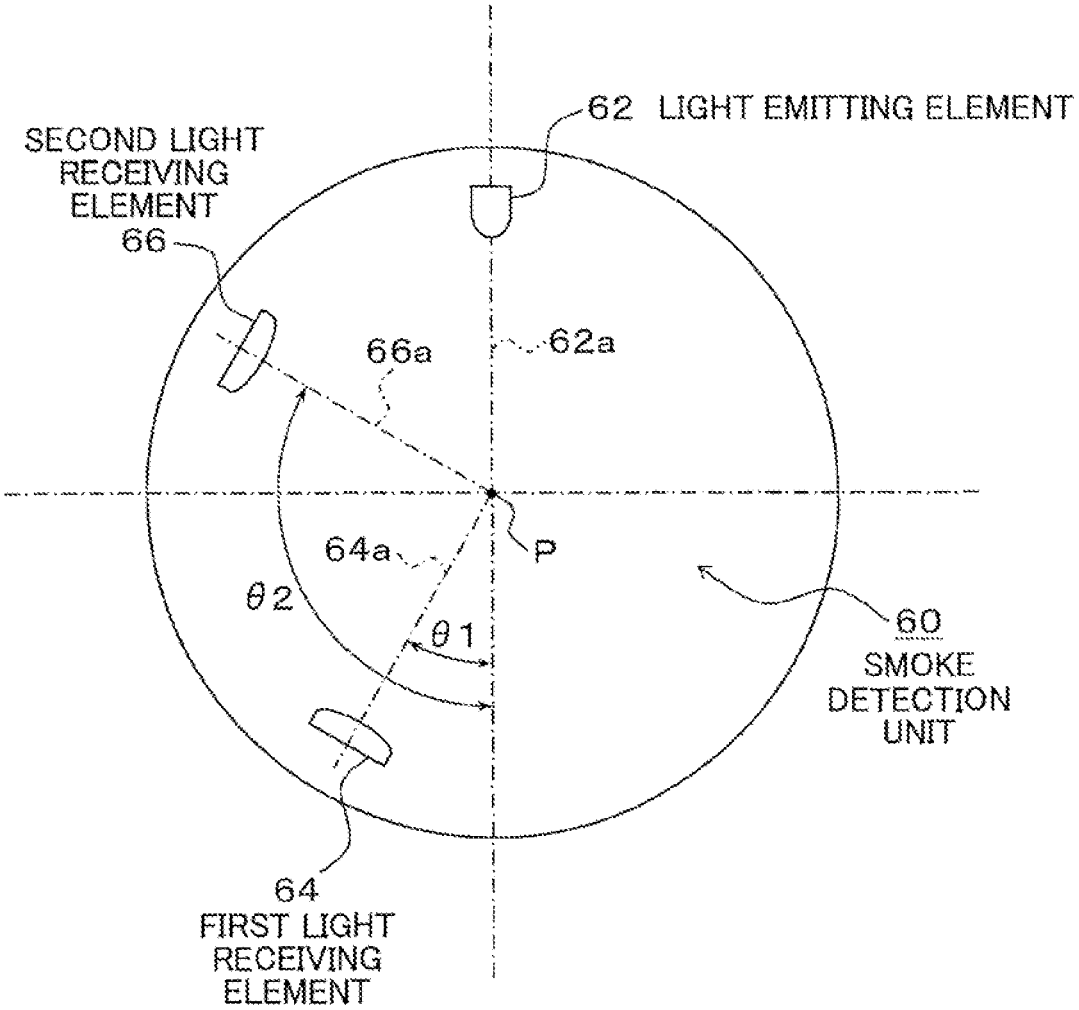

[FIG. 4]

| TYPES OF COMBUSTIBLES | $\lambda 1=700nm$ $\theta 1=30°$ | $\lambda 2=450nm$ $\theta 2=120°$ | R=A1／A2 |
|---|---|---|---|
| COTTON CANDLE WICK | 6.00E−04 | 7.50E−05 | 8.0 |
| KEROSENE | 1.20E−04 | 5.30E−05 | 2.3 |

[FIG. 5]
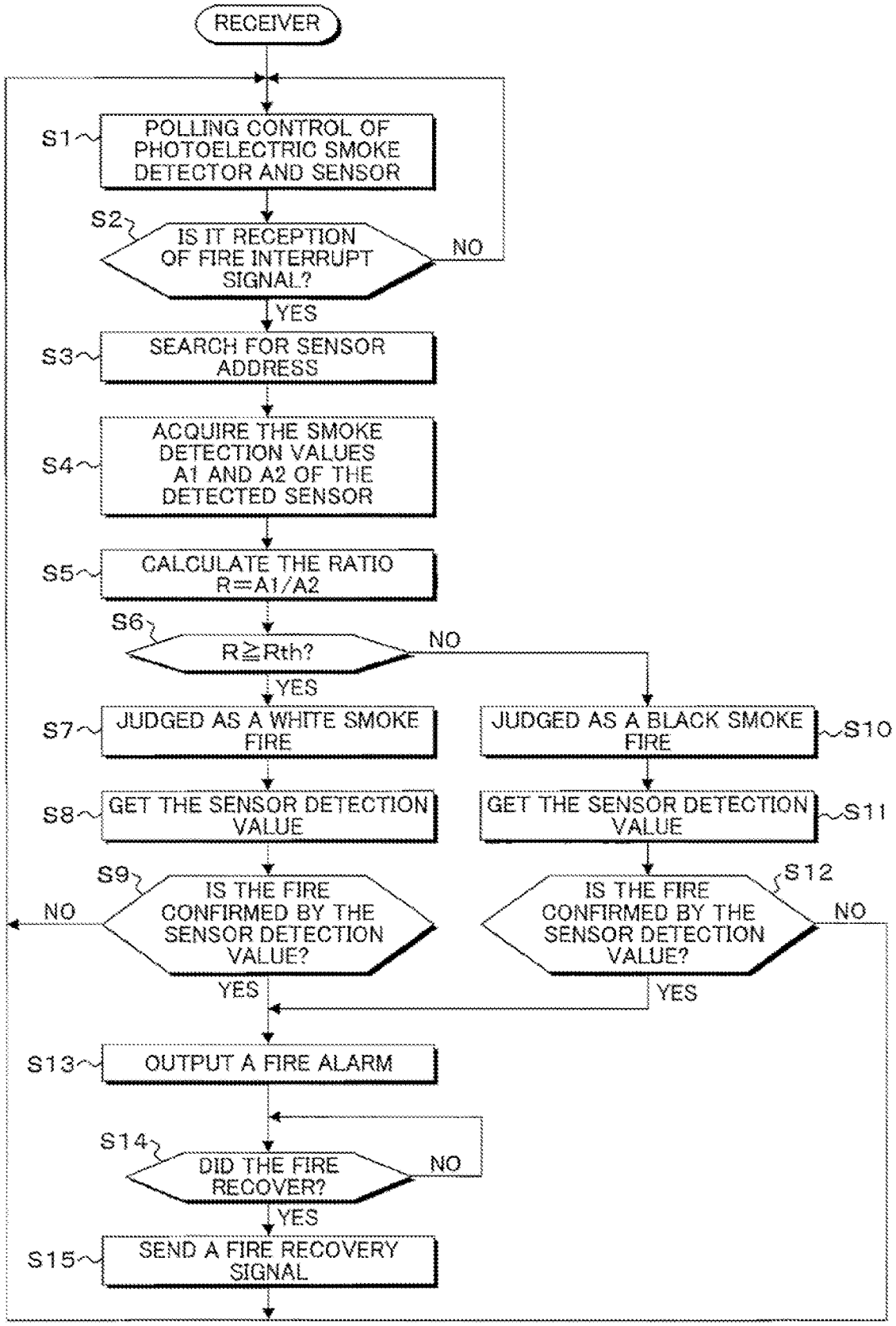

[FIG. 6]
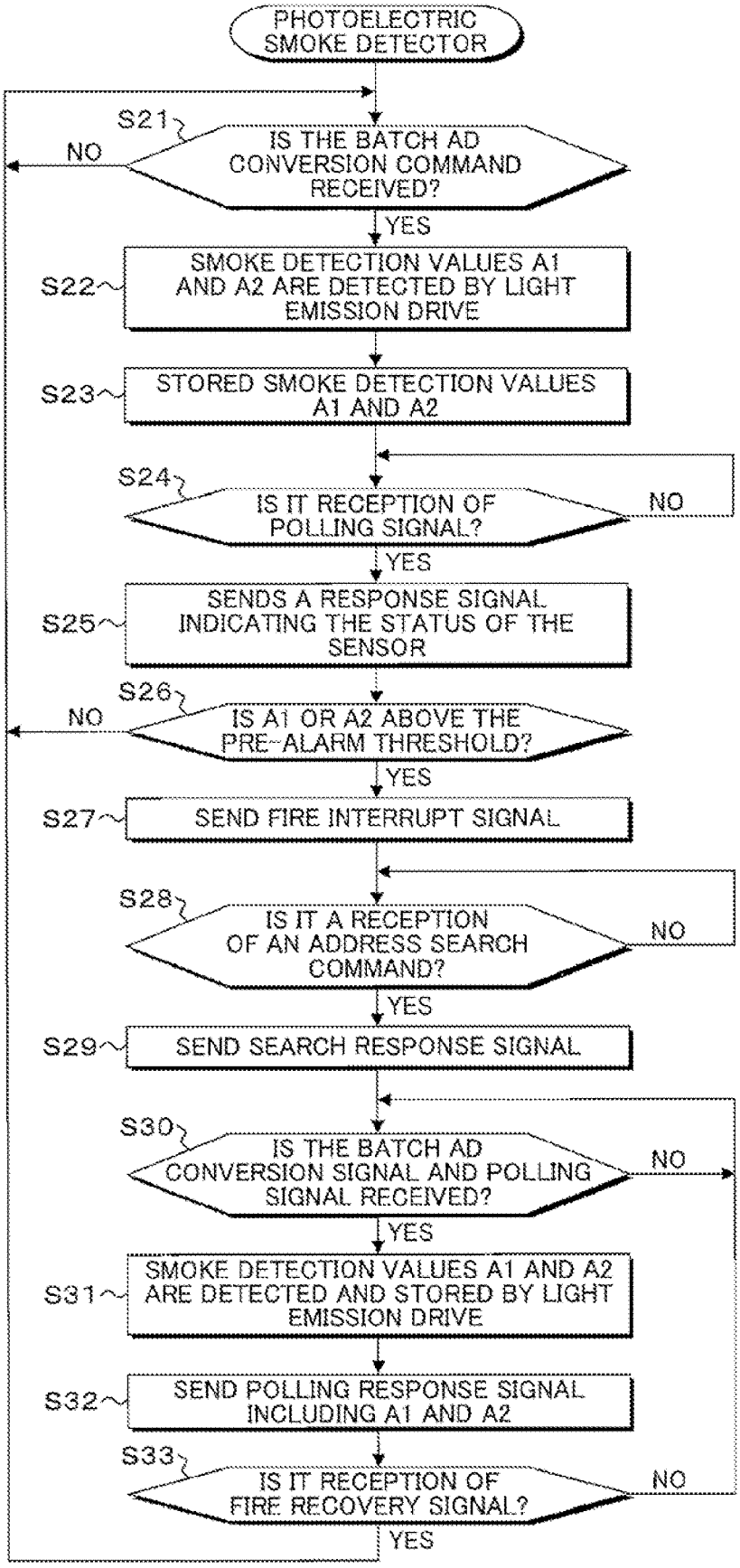

[FIG. 7]

(A)

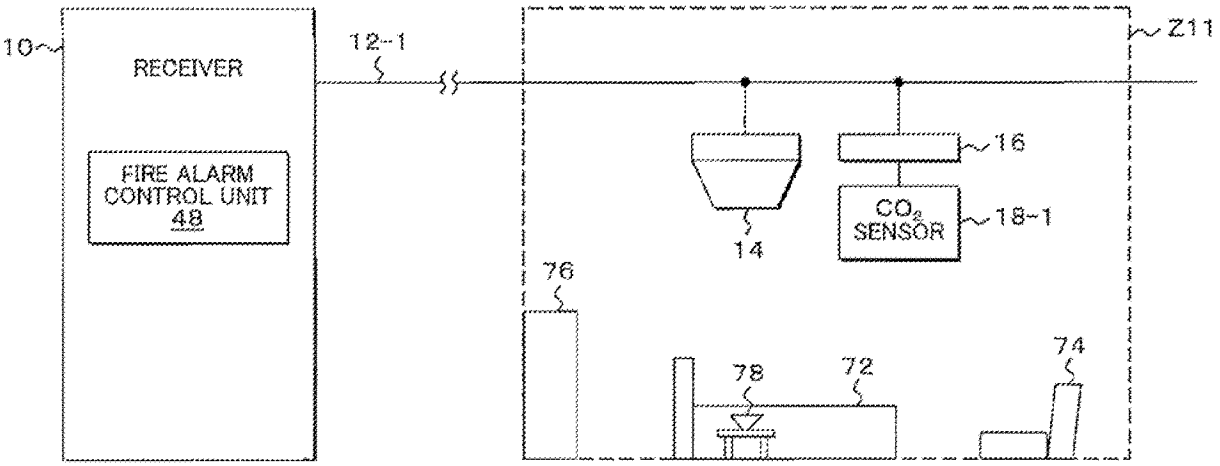

(B)

| WARNING ZONE | MODE | INPUT: DUAL WAVELENGTH DETECTOR | | INPUT: ADDITIONAL SENSOR | OUTPUT: FIRE ALARM | OUTPUT: INTERLOCKING CONTROL | |
|---|---|---|---|---|---|---|---|
| | | WHITE SMOKE | BLACK SMOKE | $CO_2$ SENSOR | | EXHAUST | AUTOMATIC FIRE NOTIFICATION | FIRE EXTINGUISHING |
| LIVING ROOM WITH BEDDING ETC. (WITH SLEEPING CIGARETTES) | A | ○ | × | × | × | × | × | × |
| | B | ○ | × | ○ | ○ | ○ | ○ | × |

○: DETECTION OR ACTIVATION ×: NON-DETECTION OR NON-ACTIVATION (C)

| WARNING ZONE | MODE | INPUT: DUAL WAVELENGTH DETECTOR | | INPUT: ADDITIONAL SENSOR | OUTPUT: FIRE ALARM | OUTPUT: INTERLOCKING CONTROL | | |
|---|---|---|---|---|---|---|---|---|
| | | WHITE SMOKE | BLACK SMOKE | $CO_2$ SENSOR | | EXHAUST | AUTOMATIC FIRE NOTIFICATION | FIRE EXTINGUISHING |
| LIVING ROOM WITH BEDDING ETC. (WITH SLEEPING CIGARETTES) | A | ○ | × | × | × | × | × | × |
| | C | ○ AND THE SECOND LEVEL OF SMOKE CONCENTRATION | × | × | ○ OR ABNORMAL ALARM | × | × | × |
| | B | ○ | ○ | ○ | ○ | ○ | ○ | × |

○: DETECTION OR ACTIVATION ×: NON-DETECTION OR NON-ACTIVATION

[FIG. 8]

(A)

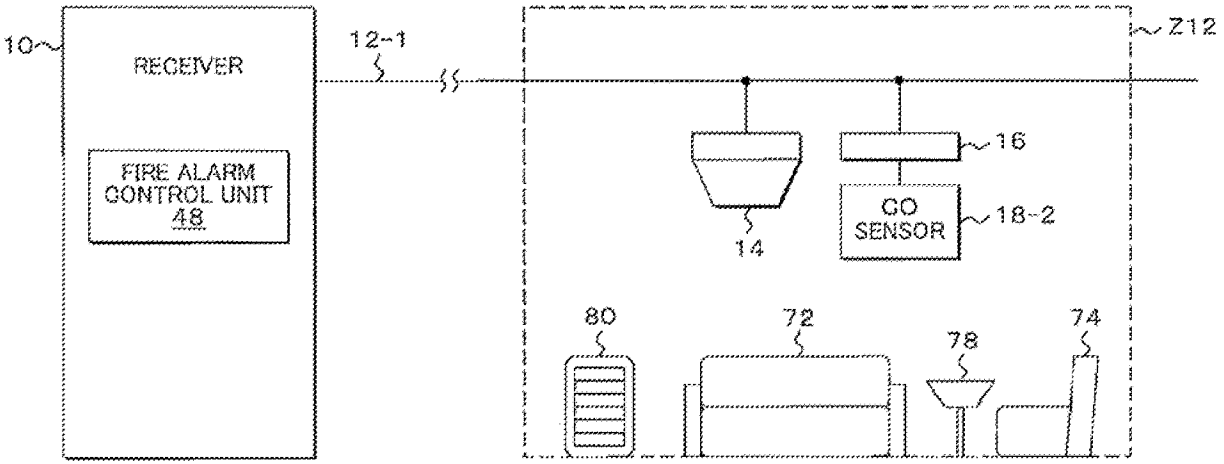

(B)

| WARNING ZONE | MODE | INPUT: DUAL WAVELENGTH DETECTOR | | ADDITIONAL SENSOR | FIRE ALARM | OUTPUT: INTERLOCKING CONTROL | | |
|---|---|---|---|---|---|---|---|---|
| | | WHITE SMOKE | BLACK SMOKE | CO SENSOR | | EXHAUST | AUTOMATIC FIRE NOTIFICATION | FIRE EXTINGUISHING |
| LIVING ROOM WITH BEDDING ETC. | A | ○ | × | × | × | × | × | × |
| | B | × | ○ | ○ | ○ | ○ | ○ | × |

○: DETECTION OR ACTIVATION ×: NON-DETECTION OR NON-ACTIVATION (C)

| WARNING ZONE | MODE | INPUT: DUAL WAVELENGTH DETECTOR | | ADDITIONAL SENSOR | FIRE ALARM | OUTPUT: INTERLOCKING CONTROL | | |
|---|---|---|---|---|---|---|---|---|
| | | WHITE SMOKE | BLACK SMOKE | CO SENSOR | | EXHAUST | AUTOMATIC FIRE NOTIFICATION | FIRE EXTINGUISHING |
| LIVING ROOM WITH BEDDING ETC. | A | ○ | × | × | × | × | × | × |
| | C | ○ AND THE SECOND LEVEL OF SMOKE CONCENTRATION | × | × | ○ OR ABNORMAL ALARM | × | × | × |
| | B | × | ○ | ○ | ○ | ○ | ○ | × |

○: DETECTION OR ACTIVATION ×: NON-DETECTION OR NON-ACTIVATION

[FIG. 9]

(A)

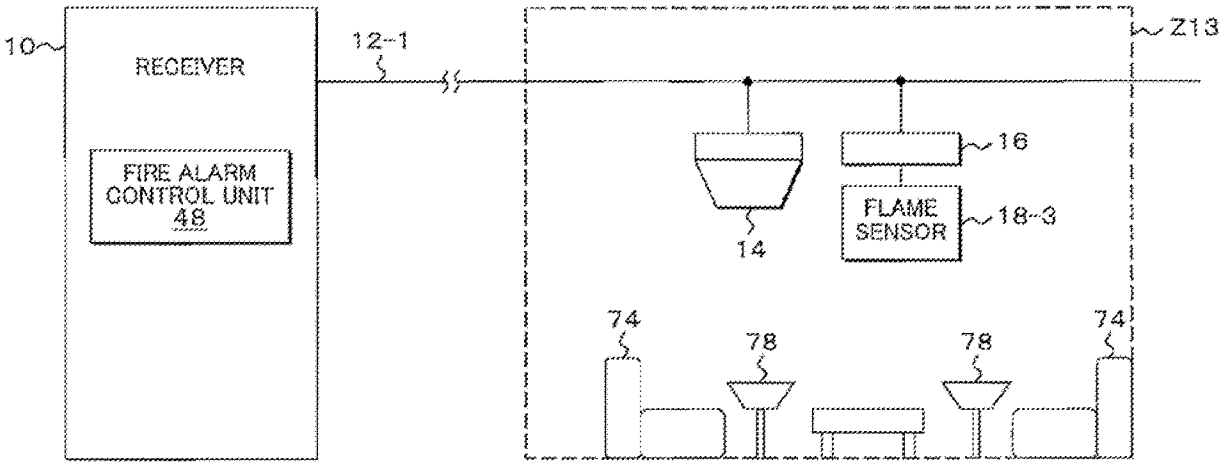

(B)

| WARNING ZONE | MODE | INPUT: DUAL WAVELENGTH DETECTOR: WHITE SMOKE | INPUT: DUAL WAVELENGTH DETECTOR: BLACK SMOKE | INPUT: ADDITIONAL SENSOR: FLAME SENSOR | OUTPUT: FIRE ALARM | OUTPUT: INTERLOCKING CONTROL: EXHAUST | OUTPUT: INTERLOCKING CONTROL: AUTOMATIC FIRE NOTIFICATION | OUTPUT: INTERLOCKING CONTROL: FIRE EXTINGUISHING |
|---|---|---|---|---|---|---|---|---|
| SMOKING ROOM | A | ○ | × | × | × | × | × | × |
| | B | × | ○ | ○ | ○ | ○ | ○ | × |

○: DETECTION OR ACTIVATION ×: NON-DETECTION OR NON-ACTIVATION (C)

| WARNING ZONE | MODE | INPUT: DUAL WAVELENGTH DETECTOR: WHITE SMOKE | INPUT: DUAL WAVELENGTH DETECTOR: BLACK SMOKE | INPUT: ADDITIONAL SENSOR: FLAME SENSOR | OUTPUT: FIRE ALARM | OUTPUT: INTERLOCKING CONTROL: EXHAUST | OUTPUT: INTERLOCKING CONTROL: AUTOMATIC FIRE NOTIFICATION | OUTPUT: INTERLOCKING CONTROL: FIRE EXTINGUISHING |
|---|---|---|---|---|---|---|---|---|
| SMOKING ROOM | A | ○ | × | × | × | × | × | × |
| | C | ○ AND THE SECOND LEVEL OF SMOKE CONCENTRATION | × | × | ○ OR ABNORMAL ALARM | × | × | × |
| | B | × | ○ | ○ | ○ | ○ | ○ | × |

○: DETECTION OR ACTIVATION ×: NON-DETECTION OR NON-ACTIVATION

[FIG. 10]
(A)
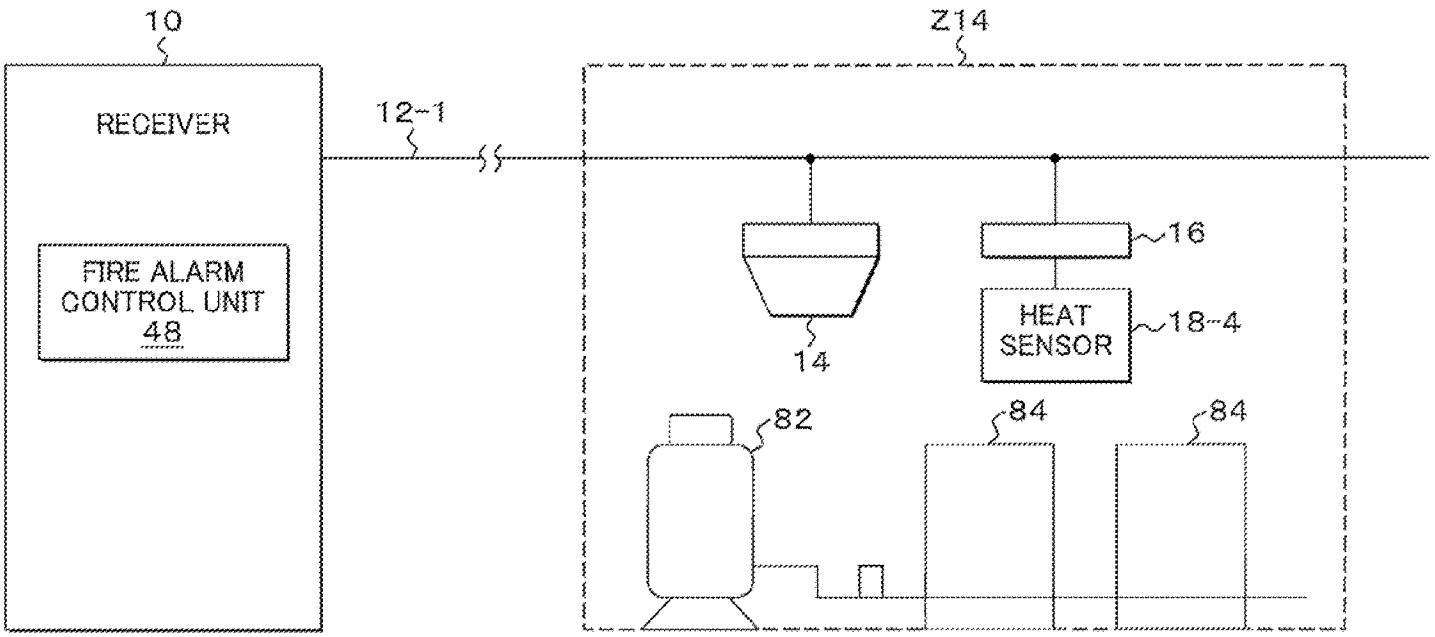
(B)
| WARNING ZONE | MODE | INPUT | | | | | OUTPUT | | | |
|---|---|---|---|---|---|---|---|---|---|---|
| | | DUAL WAVELENGTH DETECTOR | | | ADDITIONAL SENSOR | FIRE ALARM | INTERLOCKING CONTROL | | | |
| | | WHITE SMOKE | BLACK SMOKE | HEAT SENSOR | | | EXHAUST | AUTOMATIC FIRE NOTIFICATION | FIRE EXTINGUISHING |
| DANGEROUS GOODS WAREHOUSE STORING LIQUID FUEL | A | × | ○ | × | | ○ | × | × | × |
| | B | × | ○ | ○ | | ○ | ○ | ○ | ○ |
○: DETECTION OR ACTIVATION × : NON-DETECTION OR NON-ACTIVATION

[FIG. 11]
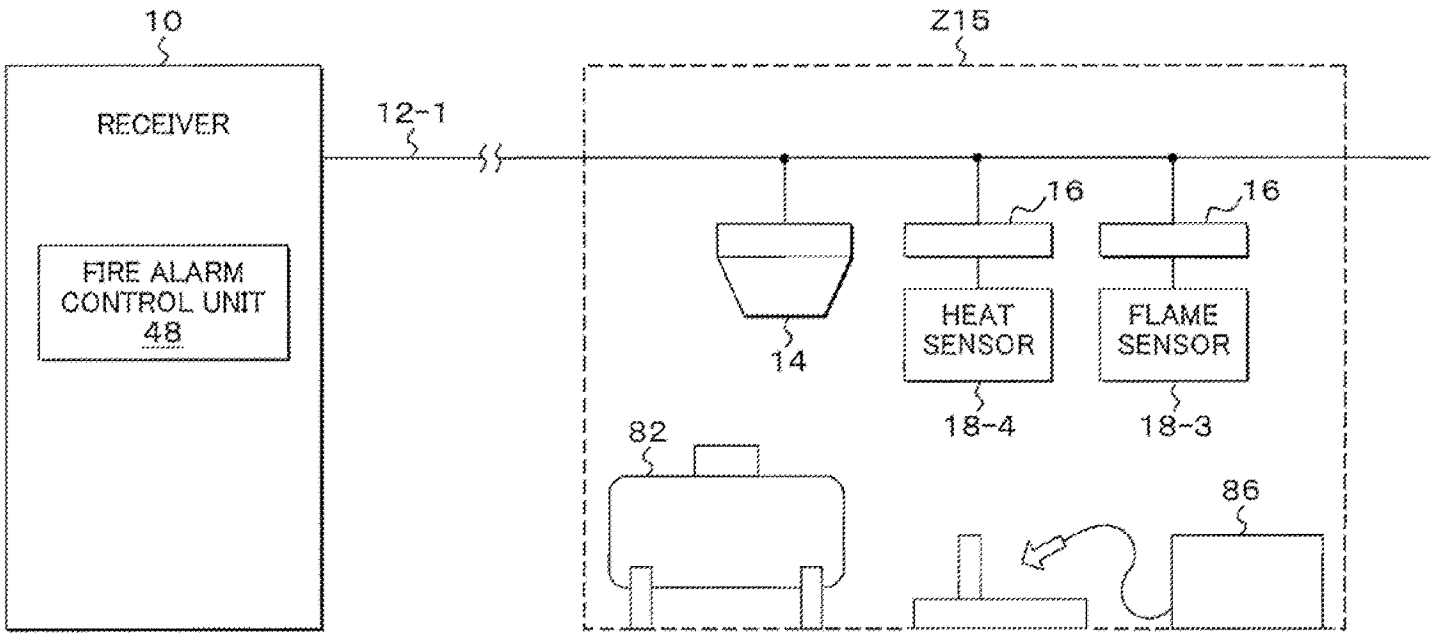
(A)
| WARNING ZONE | MODE | INPUT | | | | | OUTPUT | | |
|---|---|---|---|---|---|---|---|---|---|
| | | DUAL WAVELENG TH DETECTOR | | ADDITIONAL SENSOR | | | FIRE ALARM | INTERLOCKING CONTROL | |
| | | WHITE SMOKE | BLACK SMOKE | HEAT SENSOR | FLAME SENSOR | | | EXHAUST | AUTOMATIC FIRE NOTIFICATION | FIRE EXTINGUISHING |
| DANGEROUS GOODS WAREHOUSE STORING LIQUID FUEL | A | ○ | × | × | × | | ○ | × | × | × |
| | B | × | ○ | ○ | ○ | | ○ | ○ | ○ | ○ |
○: DETECTION OR ACTIVATION × : NON-DETECTION OR NON-ACTIVATION
(B)

FIRE ALARM EQUIPMENT

TECHNICAL FIELD

The present invention relates to a fire alarm equipment for connecting a fire detector to a receiver to monitor a fire.

BACKGROUND ART

Conventionally, in the fire alarm equipment known as the R type, a fire detector having a transmission function in which a unique address is set is connected to the receiver. In the normal monitoring state, the receiver collects and monitors the detected values such as smoke concentration and temperature by polling the fire detector in which the detector addresses are sequentially specified. In the event of a fire, based on the fire interrupt signal from the fire detector, a search command is issued from the receiver to identify the address of the activated fire detector and collect the detected value. When the detected value exceeds a predetermined fire alarm threshold value, the receiver determines that it is a fire and outputs a fire alarm. Furthermore, the receiver is designed to perform interlocking control such as exhaust device, fire proof door, and automatic notification to the fire department.

Further, in the conventional fire alarm equipment, a photoelectric smoke detector that detects smoke generated by a fire is used as the fire detector. The conventional photoelectric smoke detector is not limited to the case where it is activated by smoke generated by a fire, but it may be activated by cooking smoke, steam in a bathroom, etc., and may generate a non-fire alarm.

In order to prevent non-fire alarms caused by causes other than such a fire, a so-called two-wavelength type photoelectric smoke detector has been proposed. The two-wavelength photoelectric smoke detector irradiates the smoke detection space with light of two kinds of wavelengths, and determines the type of smoke by obtaining the ratio of the light intensities of different wavelengths to the scattered light by the smoke. This will increase the accuracy of smoke identification and ensure non-fire alarm prevention (Patent Document 2).

RELATED ART DOCUMENTS

Patent Documents

Patent document 1: JP-A No. 2007-265353
Patent document 2: JP-A No. 2004-325211

Summary of Invention

Problems to be Solved by the Invention

By the way, when such a conventional two-wavelength photoelectric smoke detector is connected to a receiver to monitor a fire, the receiver identifies whether it is white smoke generated by a smoked fire or black smoke generated by a combustion fire, and outputs a fire alarm including the identification result. This makes it possible to respond according to the degree of fire risk.

However, when steam from a bathroom or the like flows into the photoelectric smoke detector, an identification result close to white smoke generated by a smoke fire may be obtained. Therefore, there is a possibility that a fire alarm is output even though the non-fire factor due to steam or the like is judged to be a white smoke fire and it is not a fire.

An object of the present invention is to provide a fire alarm equipment that enhances the accuracy of fire judgment by smoke identification and further ensures the prevention of non-fire alarms.

Means to Solve the Problems (Fire Alarm Equipment)

Afire alarm equipment for monitoring and alerting fires in the warning area, the fire alarm equipment comprising, a photoelectric smoke detector that connects to a receiver and sends a fire signal containing identification information of the smoke that occurred in a predetermined warning zone, a sensor that is installed in the same warning zone as the photoelectric smoke detector and detects a change of physical phenomenon other than smoke associated with a fire, and a fire alarm control unit provided in the receiver to determine a fire and output a fire alarm based on the identification information of the smoke by the fire signal from the photoelectric smoke detector and the detection signal from the sensor.

Here, the warning zone is a concept indicating a unit of an area that can be specified as a fire place, for example, and means a room partitioned by a wall in the warning are, a section partitioned by a ceiling beam, or the like. In a plurality of warning zones, their shapes, space volumes, floor areas, etc. are arbitrary and do not have to be the same.

(Fire Judgment Based on the Combination of White Smoke Fire or Black Smoke Fire and Sensor Detection Value)

The sensor is at least one of a $CO_2$ sensor that detects $CO_2$ generated by a fire, a CO sensor that detects CO generated by a fire, a flame sensor that detects a flame generated by a fire, or a heat sensor that detects a heat generated by a fire, and the fire alarm control unit of the receiver outputs the fire alarm upon it determines the identification information of the smoke and the detection value by at least one of the $CO_2$ sensor, the CO sensor, the flame sensor, or the heat sensor.

(Fire Judgment by White Smoke Fire and $CO_2$ Detection)

The fire alarm control unit of the receiver outputs the fire alarm upon it determines that a white smoke fire and $CO_2$ detection by the $CO_2$ sensor.

(White Smoke Fire and Fire Judgment by CO Detection)

The fire alarm control unit of the receiver outputs the fire alarm upon it determines that a white smoke fire and CO detection by the CO sensor.

(Fire Judgment by Black Smoke Fire and Flame Detection)

The fire alarm control unit of the receiver outputs the fire alarm upon it determines that a black smoke fire and flame detection by the flame sensor.

(Fire Judgment by Black Smoke Fire and Heat Detection)

The fire alarm control unit of the receiver outputs the fire alarm upon it determines that a black smoke fire and heat detection by the heat sensor.

(Fire Judgment by Black Smoke Fire, Flame Detection and Heat Detection)

The fire alarm control unit of the receiver outputs the fire alarm upon it determines that a black smoke fire, flame detection by the flame sensor and heat detection by the heat sensor.

(Multi Sensor)

The photoelectric smoke detector is integrally provided with at least one of a $CO_2$ sensor, a CO sensor, a flame sensor, and a heat sensor.

(Interlocking Control According to the Division Type)

The fire alarm control unit of the receiver stores in advance a correspondence between a type of the warning zone and a interlocking control, and upon a fire is determined, performs the interlocking control corresponding to the type of the warning zone.

(Smoke Identification on the SENSOR side)

The photoelectric smoke detector comprising, a smoke detection unit detects a first smoke detection value by receiving a light of a first wavelength and the scattered light of the smoke by setting a first scattering angle, and detects a second smoke detection value by receiving a light of the second wavelength different from the light of the first wavelength and a scattered light of the smoke by setting a second scattering angle different from the first scattering angle, and a detector control unit that identifies smoke based on the first smoke detection value and the second smoke detection value detected by the smoke detection unit, and transmits a fire signal containing the identified identification information of the smoke to the receiver.

(Smoke Identification on the Receiver Side)

the photoelectric smoke detector comprising, a smoke detection unit detects a first smoke detection value by receiving a light of a first wavelength and the scattered light of the smoke by setting a first scattering angle, and detects a second smoke detection value by receiving a light of the second wavelength different from the light of the first wavelength and a scattered light of the smoke by setting a second scattering angle different from the first scattering angle, and a detector control unit that transmits a smoke detection value detection signal including the first smoke detection value and the second smoke detection value detected by the smoke detection unit to the receiver, wherein the fire alarm control unit of the receiver identifies smoke based on the first smoke detection value and the second smoke detection value received from the photoelectric smoke detector.

Effects of the Invention (Basic Effect)

The present invention is in a fire alarm equipment for monitoring and alerting fires in the warning area, the fire alarm equipment comprising a photoelectric smoke detector that connects to a receiver and sends a fire signal containing identification information of the smoke that occurred in a predetermined warning zone, a sensor that is installed in the same warning zone as the photoelectric smoke detector and detects a change of physical phenomenon other than smoke associated with a fire, and a fire alarm control unit provided in the receiver to determine a fire and output a fire alarm based on the identification information of the smoke by the fire signal from the photoelectric smoke detector and the detection signal from the sensor. Therefore, the detection value of a change of physical phenomenon other than smoke associated with the fire by the sensor installed in the same warning zone to the identification result of white smoke fire or black smoke fire, the accuracy of fire judgment is improved and non-fire alarm prevention can be made more reliable.

(Effect of Fire Judgment by Combining White Smoke Fire or Black Smoke Fire and Sensor Detection Value)

The sensor is at least one of a $CO_2$ sensor that detects $CO_2$ generated by a fire, a CO sensor that detects CO generated by a fire, a flame sensor that detects a flame generated by a fire, or a heat sensor that detects a heat generated by a fire, and the fire alarm control unit of the receiver outputs the fire alarm upon it determines the identification information of the smoke and the detection value by at least one of the $CO_2$ sensor, the CO sensor, the flame sensor, or the heat sensor. Therefore, when both the identification result of the white smoke fire or the black smoke fire and the detection value by any of $CO_2$ sensor, CO sensor, flame sensor and heat sensor are obtained, it is judged as a fire and an alarm is given. As a result, the accuracy of fire judgment can be improved, and the prevention of non-fire alarms can be further ensured.

(Effect of Fire Judgment by White Smoke Fire and CO2 Detection)

The fire alarm control unit of the receiver outputs the fire alarm upon it determines that a white smoke fire and $CO_2$ detection by the $CO_2$ sensor. Therefore, if a white smoke fire is determined but $CO_2$ is not detected by the $CO_2$ sensor, it is determined that some non-fire factor exists, and monitoring is continued without performing the fire alarm. On the other hand, for example, when the bedding in the living room is smoked due to sleeping cigarettes or the like and the white smoke fire is detected, by detecting the occurrence of $CO_2$ with $CO_2$ sensor and the fire alarm can be output.

(Effect of Fire Judgment by White Smoke Fire and CO Detection)

The fire alarm control unit of the receiver outputs the fire alarm upon it determines that a white smoke fire and CO detection by the CO sensor. Therefore, if a white smoke fire is determined but CO is not detected by CO sensor, it is determined that there is some non-fire factor, and monitoring is continued without performing a fire alarm. On the other hand, for example, when furniture such as a sofa is ignited by heating the stove in the living room and smoked while generating white smoke and CO, and a white smoke fire is determined, by detecting the occurrence of CO with CO sensor and a fire alarm can be output.

(Fire Judgment by Black Smoke Fire and Flame Detection)

The fire alarm control unit of the receiver outputs the fire alarm upon it determines that a black smoke fire and flame detection by the flame sensor. Therefore, if the black smoke fire is determined but the flame sensor does not detect the flame, it is determined that there is some non-fire factor, and monitoring is continued without performing the fire alarm. On the other hand, for example, when a fire is transferred from an ashtray to a sofa or the like due to mismanagement of cigarettes in a smoking room, and black smoke is determined to be burned by raising black smoke, by detecting the occurrence of flame with the flame sensor, it is possible to confirm the fire and output the fire alarm.

(Effect of Fire Judgment by Black Smoke Fire and Heat Detection)

The fire alarm control unit of the receiver outputs the fire alarm upon it determines that a black smoke fire and heat detection by the heat sensor. Therefore, if a black smoke fire is determined but heat is not detected by the heat sensor, it is determined that there is some non-fire factor, and monitoring is continued without performing a fire alarm. On the other hand, for example, if liquid fuel leaks from the liquid fuel tank installed in the dangerous goods warehouse, ignites from the electrical system, and flames and black smoke rise, in addition to judging the black smoke fire, by detecting the occurrence of a flame with a flame sensor, it is possible to confirm a fire and output a fire alarm.

(Effect of Fire Judgment by Black Smoke Fire, Flame Detection and Heat Detection)

The fire alarm control unit of the receiver outputs the fire alarm upon it determines that a black smoke fire, flame detection by the flame sensor and heat detection by the heat sensor. Therefore, if the black smoke fire is determined, but the flame sensor flame and heat sensor heat are not detected, it is determined that there is some non-fire factor, and monitoring is continued without performing the fire alarm. On the other hand, for example, in a factory with a fuel tank and a welding machine, if a spark from welding ignites a nearby fuel tank and explosively raises flames and black smoke, in addition to the judgment of black smoke fire, by detecting the occurrence of the flame with the heat sensor, it is possible to confirm the fire and output the fire alarm.

(Effect of Multi-Sensor)

The photoelectric smoke detector is integrally provided with at least one of a CO2 sensor, a CO sensor, a flame sensor, and a heat sensor. For this reason, one or more sensors that detect a change of physical phenomenon other than smoke associated with the fire should be integrated into the photoelectric smoke detector that transmits a fire signal to identify a white smoke fire or a black smoke fire. It is easy to install a sensor for warning area. In addition, by detecting the smoke of the fire and the value of a change of physical phenomenon other than the smoke at the same position of the warning area, the accuracy of the fire judgment can be improved.

Furthermore, by integrating the photoelectric smoke detector and various sensors, it is possible to reduce the number of parts by sharing the processing circuit and integrating the structural parts, and it is possible to reduce the overall cost. It is also possible to reduce the number of addresses as an analog system. Of course, by reducing the number of detectors installed on the ceiling of the room, it is possible to improve the design of the building design.

(Effect of Interlocking Control According to DIVISION type)

The fire alarm control unit of the receiver stores in advance a correspondence between a type of the warning zone and a interlocking control, and upon a fire is determined, performs the interlocking control corresponding to the type of the warning zone. Therefore, for example, the correspondence between the type of section such as a warehouse where dangerous materials such as living room, smoking room, fuel tank are installed, and interlocking control such as exhaust, automatic notification, is stored in advance for each warning zone in which the photoelectric smoke detector is installed. As a result, for example, when the fire section is a living room, the fire does not spread suddenly, so it is possible to perform human measures such as initial fire extinguishing by performing interlocking control such as exhaust gas and automatic notification. On the other hand, if the fire section is a warehouse or the like where dangerous materials such as fuel tanks are installed, there is a risk of rapid fire spread. In this case, in addition to exhaust and automatic notification, automatic fire extinguishing by spraying a fire extinguishing agent or the like can be performed to deal with the problem.

(Effect of Smoke Identification on the Sensor Side)

The photoelectric smoke detector comprising a smoke detection unit detects a first smoke detection value by receiving a light of a first wavelength and the scattered light of the smoke by setting a first scattering angle, and detects a second smoke detection value by receiving a light of the second wavelength different from the light of the first wavelength and a scattered light of the smoke by setting a second scattering angle different from the first scattering angle, and a detector control unit that identifies smoke based on the first smoke detection value and the second smoke detection value detected by the smoke detection unit, and transmits a fire signal containing the identified identification information of the smoke to the receiver. Therefore, since the smoke is identified on the photoelectric smoke detector side based on the two types of smoke detection values detected by setting different wavelengths and scattering angles, the processing load on the receiver side can be reduced.

(Effect of Smoke Identification on the RECEIVER side)

The photoelectric smoke detector comprising a smoke detection unit detects a first smoke detection value by receiving a light of a first wavelength and the scattered light of the smoke by setting a first scattering angle, and detects a second smoke detection value by receiving a light of the second wavelength different from the light of the first wavelength and a scattered light of the smoke by setting a second scattering angle different from the first scattering angle, and a detector control unit that transmits a smoke detection value detection signal including the first smoke detection value and the second smoke detection value detected by the smoke detection unit to the receiver, wherein the fire alarm control unit of the receiver identifies smoke based on the first smoke detection value and the second smoke detection value received from the photoelectric smoke detector. Therefore, since the receiver side distinguishes between white smoke fire and black smoke fire based on the two types of smoke detection values detected by the photoelectric smoke detector, the configuration and control function of the photoelectric smoke detector becomes much simpler. In addition, the current consumption of the photoelectric smoke detector can be reduced.

BRIEF DESCRIPTION OF THE DRAWINGS

FIG. 1 is an explanatory diagram showing an embodiment of fire alarm equipment.

FIG. 2 is a block diagram showing a circuit configuration of a photoelectric smoke detector provided in the fire alarm equipment of FIG. 1.

FIG. 3 is an explanatory diagram showing an embodiment of the structure of the smoke detection unit in FIG. 2.

FIG. 4 is an explanatory diagram showing the smoke detection values detected by the smoke detection unit structure of FIG. 2 and their ratios with respect to the smoke when the cotton wick and kerosene are burned.

FIG. 5 is a flowchart showing the control operation in the receiver of FIG. 1.

FIG. 6 is a flowchart showing the control operation in the photoelectric smoke detector of FIG. 2.

FIG. 7 is an explanatory diagram showing fire judgment and interlocking control when $CO_2$ sensor is installed in the warning zone of the photoelectric smoke detector.

FIG. 8 is an explanatory diagram showing fire judgment and interlocking control when the CO sensor is installed in the warning zone of the photoelectric smoke detector.

FIG. 9 is an explanatory diagram showing fire judgment and interlocking control when the flame sensor is installed in the warning zone of the photoelectric smoke detector.

FIG. 10 is an explanatory diagram showing fire judgment and interlocking control when the heat sensor is installed in the warning zone of the photoelectric smoke detector.

FIG. 11 is an explanatory diagram showing fire judgment and interlocking control when the flame sensor and the heat sensor are installed in the warning zone of the photoelectric smoke detector.

DETAILED DESCRIPTION OF THE INVENTION (Overview of Fire Alarm Equipment)

FIG. 1 is an explanatory diagram showing an embodiment of fire alarm equipment. As shown in FIG. 1, for example, an R-shaped receiver 10 is installed in a monitoring center or a manager's room of a facility where the fire alarm equipment 100 is installed. Signal lines 12-1 to 12-3 are drawn out from the receiver 10 separately for each system with respect to the warning area.

A plurality of photoelectric smoke detectors 14 having a transmission function in which unique addresses are set are connected to signal line 12-1. The photoelectric smoke detector 14 is a so-called two-wavelength photoelectric smoke detector, which detects a first smoke detection value A1 by receiving a light of the first wavelength λ1 and a scattered light of a smoke by setting a first scattering angle θ1, and at the same time, a second smoke detection value A2 is detected by receiving a light of the second wavelength λ2 and a scattered light of the smoke by setting a second scattering angle θ2.

Here, the first smoke detection value A1 and the second smoke detection value A2 may be simply referred to as a smoke detection value A1 and a smoke detection value A2 in the following description.

Further, in addition to the so-called two-wavelength type photoelectric smoke detector 14, a normal photoelectric smoke detector having a transmission function and a heat detector are connected to the signal line 12-1. Further more, a relay device having a transmission function is connected to the signal line 12-1, and an on/off type fire detector or a transmitter is connected to the sensor line from which the relay device is pulled out. However, in each case, the illustration is omitted.

The photoelectric smoke detector 14 connected to the signal line 12-1 is installed in each of warning zones Z1 and Z2, which are the installation units. The warning zones Z1 and Z2 are rooms separated by walls, sections separated by ceiling beams, sections for each predetermined length such as corridors, etc. Normally, one photoelectric smoke detector 14 is installed in one warning zone. However, it does not prevent multiple units from being installed.

In addition to this, in the present embodiment, a sensor 18 for detecting a change of physical phenomenon other than smoke associated with a fire is additionally installed in each of the warning zones Z1 and Z2 in which the photoelectric smoke detector 14 is installed. The sensor 18 is connected to the signal line 12-1 from the receiver 10 via a relay device 16 having a unique address set and having a transmission function.

The sensor 18 is at least one of a $CO_2$ sensor that detects $CO_2$ generated by a fire, a CO sensor that detects CO generated by a fire, a flame sensor that detects a flame generated by a fire, or a heat sensor that detects heat generated by a fire. Normally, one of these sensors is installed in one section, but it does not prevent the installation of a plurality of these sensors in one section. Further, it is not essential that the detection target is the same for all the sections.

Control devices such as an area sound device 20, an exhaust device 22, and a fire proof door 24 are connected to the signal lines 12-2 and 12-3 via the relay device 16 having a transmission function in which a unique address is set. The area sound device 20 outputs a predetermined area sound alarm notifying the warning are of the occurrence of a fire under the control of the receiver 10.

The exhaust device 22 is activated by a control instruction from the receiver 10 to ventilate the warning area. The fire proof door 24 is activated to the closed position by releasing the latch of the open holding by the control instruction from the receiver 10, and closes the section where the fire has occurred to suppress the spread of the fire.

The maximum number of addresses for each line set in terminal devices such as the photoelectric smoke detector 14 and the relay device 16 connected to the signal lines 12-1 to 12-3 is, for example, 255. Therefore, a maximum of 255 terminal devices can be connected to each of the signal lines 12-1 to 12-3.

(Functional Configuration of Receiver)

The receiver 10 is provided with a main CPU 26 and sub CPU substrates 28-1 to 38-3, and each of the sub CPU substrates 28-1 to 28-3 is provided with a sub CPU 30 and a transmission unit 32. The main CPU 26 and the sub CPU 30 are connected by a serial transmission bus 34, and transmit and receive data to and from each other.

The main CPU 26 has a display 36 with a touch panel using a liquid crystal display panel, an indicator unit 38 provided with a representative light for fire, gas leak, and obstacles, an LED indicator light, etc., an operation unit 40 provided with various switches necessary for fire monitoring such as a switch, a sound alarm unit 42 provided with a speaker, and an alarm transfer unit 44 are connected.

An automatic notification device 102, an emergency announcement equipment 104, a fire extinguishing equipment 106, or the like is connected to the alarm transfer unit 44 as a transfer destination. The automatic notification device 102 activates by the transfer signal from the receiver 10 and notifies the fire department and the guard room of the fire occurrence via the public telephone line.

The emergency announcement equipment 104 activates by the transfer signal from the receiver 10, and outputs an emergency broadcast for notifying the occurrence of a fire and guiding evacuation from a speaker installed in the warning area. When the emergency announcement equipment 104 is activated, the district sound alarm by the area sound device 20 is stopped.

The fire extinguishing equipment 106 is, for example, a dry fire extinguishing equipment equipped with an open sprinkler head, and a branch pipe is pulled out from the water supply main for each predetermined protection section to connect the open sprinkler head. In the event of a fire, fire extinguishing water is supplied from the pressurized water supply source and sprayed by opening the simultaneous release valve provided at the branch part of the branch pipe. The fire extinguishing equipment 106 also includes a foam fire extinguishing equipment that emits fire extinguishing foam and a gas fire extinguishing equipment that emits fire extinguishing gas.

[Receiver Control Function]

As shown in FIG. 1, the main CPU 26 of the receiver 10 is provided with a fire alarm control unit 48 as a function realized by executing a program.

Further, the sub CPU 30 provided on the sub CPU substrates 28-1 to 28-3 of the receiver 10 is provided with a transmission control unit 46 as a function realized by executing the program. The transmission control unit 46 provided in the sub CPU 30 of the sub CPU substrate 28-1 controls to collect the first smoke detection value A1 and the second smoke detection value A2 detected by the two-wavelength photoelectric smoke detector connected to the signal line 12-1. Also the transmission control unit 46 control to collect the detected value detected by the sensor 18 connected to the signal line 12-1.

Further, the transmission control unit 46 of the sub CPU substrates 28-2 and 28-3 performs fire interlocking control. In the fire interlocking control, the transmission control unit 46 transmits a control signal specifying the address of the relay device 16 connected to each of the signal lines 12-2 and 12-3. As a result, control devices such as the area sound device 20, the exhaust device 22, and the fire proof door 24 connected to the relay device 16 are controlled.

(Collection Control of Sensor Detection Data)

The transmission control unit 46 provided in the sub CPU 30 of the sub CPU substrate 28-1 instructs the transmission unit 32 to control the collection of the detected data. The transmission unit 32 transmits and receives a signal between the photoelectric smoke detector 14 and the relay device 16 of the sensor 18 each connected to the signal line 12-1 according to a predetermined communication protocol in order to collect the detection data. In the following description, transmission/reception of sensor 18 to/from relay device 16 will be described as transmission/reception to/from sensor 18.

A downlink signal from the transmission unit 32 to the photoelectric smoke detector 14 is transmitted in a voltage mode. The signal in the voltage mode is transmitted as a voltage pulse that changes the line voltage of signal line 12-1 between, for example, 18 and 30 volts.

On the other hand, an uplink signal from the photoelectric smoke detector 14 and the sensor 18 to the transmission unit 32 is transmitted in the current mode. In the current mode, a signal current is passed through the signal line 12-1 at a timing of bit 1 of a transmission data, and the uplink signal is transmitted to the receiver 10 as a so-called current pulse train.

The data collection control by the transmission control unit 46 of the sub CPU 30 instructs the transmission unit 32 at regular intervals during normal monitoring to transmit a broadcast batch AD conversion signal including a batch AD conversion command. Upon receiving this batch AD conversion signal, the photoelectric smoke detector 14 converts and holds the detection signal including the first smoke detection value A1 and the second smoke detection value A2 output from the smoke detection unit into a digital smoke detection value signal.

Subsequently, the transmission control unit 46 of the sub CPU 30 transmits a polling signal including a polling command in which terminal addresses are sequentially specified. When the photoelectric smoke detector 14 receives the polling signal having an address matching its own address, it transmits a polling response signal including the first smoke detection value A1 and the second smoke detection value A2 held at that time to the receiver 10. Further, when the sensor 18 receives the polling signal having the address matching its own address, it transmits the polling response signal including the detected value held at that time to the receiver 10.

Further, for example, in the case where the photoelectric smoke detector 14 is equivalent to a smoke detector having a type 2 sensitivity that issues a fire at a smoke concentration of 10%/m, a pre-alarm threshold value AP1*th* for the first smoke detection value A1 is set to be, for example, a smoke concentration threshold value of 5.0%/m which is a smoke concentration threshold value corresponding to a type 1 sensitivity. The photoelectric smoke detector 14 determines that a fire is activated when the detected the first smoke detection value A1 becomes the pre-alarm threshold value AP1*th* or higher, and transmits a fire interrupt signal to the receiver 10.

On the other hand, the photoelectric smoke detector 14 may be set as the pre-alarm threshold value AP2*th* for the second smoke detection value A2, for example, the smoke concentration threshold value of 5.0%/m as the smoke concentration threshold value corresponding to the type 1 sensitivity. In this case, the photoelectric smoke detector 14 determines that the fire is activated when the detected second smoke detection value A2 becomes the pre-alarm threshold AP2*th* or higher, and transmits the fire interrupt signal to the receiver 10.

When the transmission control unit 46 of the sub CPU 30 receives the fire interrupt signal from the photoelectric smoke detector 14 via the transmission unit 32, it transmits a group search command signal to identify the group including the photoelectric smoke detector 14 that has been fire-activated. Subsequently, the transmission control unit 46 transmits an intra-group search command signal to identify the address of the photoelectric smoke detector 14 activated by the fire, and intensively collects the first and second smoke detection values A1 and A2, and then, transmits to the main CPU 26 via the serial transmission bus 34.

The intensive collection of the first and second smoke detection values A1 and A2 by the transmission control unit 46 of the sub CPU 30 shortens the transmission cycle of the batch AD conversion signal. Subsequently, after transmitting the batch AD conversion signal, a polling signal specifying the address of the fire-activated photoelectric smoke detector 14 is continuously transmitted and collected the first and second smoke detection values A1 and A2.

Further, when the transmission control unit 46 of the sub CPU 30 specifies the address of the fire-activated photoelectric smoke detector 14, it acquires the address of the sensor 18 installed in the same warning zone registered in advance. Subsequently, the transmission control unit 46 intensively collects the detected values of the sensor 18 installed in the same warning zone as the fire-activated photoelectric smoke detector 14, and transmits the detected values to the main CPU 26 via the serial transmission bus 34.

(Fire Alarm Control)

The fire alarm control unit 48 of the main CPU 26 calculates the ratio R=A1/A2 from the first smoke detection value A1 and the second smoke detection value A2 received from the sub CPU 30, compares it with a predetermined ratio threshold value Rth. As a result, when R≥Rth, a white smoke fire is judged, and when R<Rth, a black smoke fire is judged. The details of the determination of the white smoke fire and the black smoke fire by the fire alarm control unit 48 will be clarified later in the explanation of the photoelectric smoke detector 14.

Subsequently, the fire alarm control unit 48 of the main CPU 26 compares the detection value of the sensor 18 received from the sub CPU 30 with a predetermined threshold value, and if it is equal to or higher than the threshold value, determines that the sensor 18 has detected the detection value.

Subsequently, the fire alarm control unit 48 of the main CPU 26 determines the fire based on the determination result of the white smoke fire or the black smoke fire and the detection by the sensor 18. That is, the fire alarm control unit 48 of the main CPU 26 is determined to have the white smoke fire or the black smoke fire, but if the detection by the sensor 18 is not determined, it is determined that some non-fire factor exists. In this case, the fire alarm control unit 48 of the main CPU 26 does not output the fire alarm and holds it.

On the other hand, the fire alarm control unit 48 of the main CPU 26 determines the white smoke fire or the black smoke fire, and if detection by the sensor 18 is determined at this time, confirms the fire and outputs a fire alarm.

The fire alarm by the fire alarm control unit 48 turns on the fire representative light of the indicator unit 38, and outputs a predetermined main acoustic alarm indicating the occurrence of a fire from the speaker of the sound alarm unit 42. In addition, fire alarm information including the location of the fire is displayed on the display 36 based on the detector address where the fire is detected, and a predetermined interlocking control is performed as necessary.

The interlocking control of the fire alarm control unit 48 transmits a district acoustic control signal, which is the address of a sound device 20 in the warning area corresponding to the address of the photoelectric smoke detector 14 activated by the fire (that is, the address of the relay device 16 to which the area sound device 20 is connected) is specified. As a result, the area sound device 20 to which the address is specified is activated, and the district sound alarm is output.

Further, the interlocking control by the fire alarm control unit 48 transmits a control signal, and this control signal specifies the address of the exhaust device 22 installed in the warning area corresponding to the address of the photoelectric smoke detector 14 activated by the fire (that is, the address of the relay device 16 to which the exhaust device 22 is connected). As a result, when the exhaust device 22 is activated, the smoke generated by the fire is discharged to the outside to ventilate.

Further, the interlocking control of the fire alarm control unit 48 transmits another control signal, and this control signal is specified the address of the fire proof door 24 installed in the warning area corresponding to the address of the photoelectric smoke detector 14 activated by the fire (that is, the address of the relay device 16 to which the fire proof door 24 is connected). As a result, the open holding of the fire proof door 24 is released, and the fire proof door 24 is closed.

In addition, the interlocking control of the fire alarm control unit 48 outputs a transfer signal from the alarm transfer unit 44, and activites the automatic notification device 102, the emergency announcement equipment 104 and the fire extinguishing equipment 106 from this to automatically notify, broadcast or extinguish the fire. The interlocking control by the fire alarm control unit 48 is performed according to the risk level of the fire. If the risk level is low, evacuation guidance is urged by automatic notification and emergency broadcasting, and if the risk level is high, the fire is further extinguished.

The fire alarm control unit 48 fire judgment and interlocking control are performed according to the $CO_2$ sensor, CO sensor, flame sensor, or heat sensor provided as sensor 18, and the unique fire judgment and interlocking control are performed as follows.

The fire alarm control unit 48 determines the white smoke fire, but if there is no $CO_2$ detection by the $CO_2$ sensor, it determines that there is some non-fire factor and continues fire monitoring without performing the fire alarm. On the other hand, the fire alarm control unit 48 controls to output the fire alarm when it determines a fire when it determines the white smoke fire and $CO_2$ detection by a $CO_2$ sensor. In this case, the interlocking control is exhaust, automatic notification, and emergency broadcasting.

In addition, the fire alarm control unit 48 has determined the white smoke fire, but if there is no CO detection by the CO sensor, it is determined that some non-fire factor exists, and fire monitoring is continued without performing the fire alarm. On the other hand, when the fire alarm control unit 48 determines the white smoke fire and the CO detection of the CO sensor, it determines that it is a fire and controls to output the fire alarm. In this case, exhaust, automatic notification, and emergency broadcast interlocking control are performed.

In addition, the fire alarm control unit 48 has determined the black smoke fire, but if there is no flame detection by the flame sensor, it is determined that some non-fire factor exists, and fire monitoring is continued without performing the fire alarm. On the other hand, the fire alarm control unit 48 controls to output the fire alarm by determining that it is a fire when it is determined that the black smoke fire and the flame detection of the flame sensor are performed. In this case, interlocking control of exhaust, automatic notification, and emergency broadcasting is performed, and since the risk of fire is high, interlocking control of fire extinguishing is performed.

In addition, the fire alarm control unit 48 has determined the black smoke fire, but if there is no heat detection by the heat sensor, it is determined that some non-fire factor exists, and fire monitoring is continued without performing the fire alarm. On the other hand, the fire alarm control unit 48 controls to output the fire alarm by determining that it is a fire when it is determined that the black smoke fire and the heat detection of the heat sensor are performed. In this case, since the black smoke fire and heat are detected, it is judged that the risk of fire is high, and in addition to exhaust, automatic notification and emergency broadcasting, interlocking control including fire extinguishing is performed.

Furthermore, the fire alarm control unit 48 judged the black smoke fire, but if there was no flame detection of the flame sensor and heat detection of the heat sensor, it is determined that some non-fire factor exists, and fire monitoring is continued without performing the fire alarm. On the other hand, the fire alarm control unit 48 controls to output the fire alarm when it determines the black smoke fire, the flame detection of the flame sensor, and the heat detection of the heat sensor. In this case, in addition to the black smoke fire, heat and flame are detected, and it is judged that the risk of fire is high, and in addition to exhaust, automatic notification and emergency broadcasting, interlocking control including fire extinguishing is performed.

In order to perform interlocking control corresponding to such a fire judgment, the fire alarm control unit 48 stores in advance the correspondence relationship between the type of warning zone and the interlocking control, and the type of warning zone includes living room, smoking room, and fuel. Includes dangerous goods warehouses with tanks etc. For example, the fire alarm control unit 48 stores exhaust, automatic notification, and emergency broadcasting as corresponding interlocking controls when the warning zone has a low risk of fire in the living room, the smoking room, or the like. In addition, when the warning zone has a high risk of fire in a dangerous goods warehouse with the fuel tank, the fire alarm control unit 48 stores fire extinguishing in addition to exhaust, automatic notification, and emergency broadcasting as corresponding interlocking control.

FIG. 2 is a block diagram showing a circuit configuration of the photoelectric smoke detector provided in the fire alarm equipment of FIG. 1. As shown in FIG. 2, the photoelectric smoke detector 14 of the present embodiment is composed of a detector control unit 50, a transmission unit 52, a power supply unit 54, a light emitting drive unit 56, a smoke detection unit 60, and an amplifier circuit 68, 70. The detector control unit 50 is composed of a computer circuit including a CPU, a memory, and various input/output ports. The transmission unit 52 transmits/receives a signal between the receiver 10 and the receiver 10 via the signal line 12 connected to the S terminal and the SC terminal. The power supply unit 54 converts the power supply voltage supplied via the signal line 12 into a predetermined regulated voltage and outputs it.

The smoke detection unit 60 is provided with a light emitting element 62 that simultaneously emits light containing a first wavelength λ1 and a second wavelength λ2. The light of the first wavelength λ1 emitted from the light emitting element 62 has a center wavelength of 600 nm or more, and the light of the second wavelengths λ2 has a center wavelength of 500 nm or less. In the present embodiment, the first wavelength λ1 is set to, for example, 700 nm, and the second wavelength λ2 is set to, for example, 450 nm.

In this embodiment, a white LED (white light emitting diode) is used as the light emitting element 62. The white LED is, for example, a combination of a blue LED and a phosphor, and the light of the blue LED is passed through the phosphor to emit white light. This light emission includes light having the first wavelength of λ1=700 nm and light having the second wavelength of λ2=450 nm, and simultaneously irradiates the smoke detection unit 60 with light having the first wavelength of λ1 and the second wavelength of λ2.

Further, as the light emitting element 62 of the present embodiment, a two-color LED (two-color light emitting diode) can also be used. The two-color LED includes a first light emitting chip that emits light having the first wavelength of λ1=700 nm and a second light emitting chip that emits light having the second wavelength of λ2=450 nm. By driving the first light emitting chip and the second light emitting chip at the same time, the smoke detection unit 60 is irradiated with the light including the light of the first wavelength λ1 and the light of the second wavelength at the same time.

A photodiode (PD) sensitive to the first wavelength λ1 is used for the first light receiving element 64, and a photodiode (PD) sensitive to the second wavelength λ2 is used for the second light receiving element 66.

Further, the first light receiving element 64 and the second light receiving element 66 may be provided with a filter layer on the PD molding (transparent cover member) of the broadband photodiode. Here, the broadband photodiode has sensitivity in the visible light wavelength band and the filter layer receives only the respective wavelength bands of the first wavelength λ1 and the second wavelength λ2. Further, as the first light receiving element 64 and the second light receiving element 66, a filter that transmits each wavelength band of the first wavelength λ1 and the second wavelength λ2 may be arranged in front of the broadband photodiode.

The amplifier circuit 68 amplifies a received signal of the smoke scattered light of the first wavelength λ1 received by the first light receiving element 64, and outputs a received signal having the first smoke detection value A1 to the detector control unit 50. Further, the amplifier circuit 70 amplifies a received signal of a smoke scattered light received by the second light receiving element 66, and outputs a received signal having the second smoke detection value A2 to the detector control unit 50.

(Smoke Detection Unit)

FIG. 3 is an explanatory diagram showing an embodiment of the structure of the smoke detection unit in FIG. 2. As shown in FIG. 3, the light emitting element 62, the first light receiving element 64, and the second light receiving element 66 are arranged in the smoke detection unit 60 into which smoke from the outside flows.

For example, the light emitting element 62 using the white LED irradiates light including the first wavelength λ1 and the second wavelength λ2 in the optical axis 62*a* direction, and as described above, the light of the first wavelength λ1 is set to 700 nm and the light of the second wavelength λ2 is set to 450 nm.

A first scattering angle θ1 composed of the intersection of an optical axis 62*a* of the light emitting element 62 and an optical axis 64*a* of the first light receiving element 64 is defined in a range of 20° to 70° and arranged.

Further, a second scattering angle θ2 formed by the intersection of the optical axis 62*a* of the light emitting element 62 and an optical axis 66*a* of the second light receiving element 66 is defined in a range of 90° to 170° and arranged.

In the present embodiment, since the first scattering angle θ1 is set to 30°, the optical axis 62*a* of the light emitting element 62 and the optical axis 64*a* of the first light receiving element 64 are arranged so as to intersect at a scattering angle of, for example, 30°. Further, since the second scattering angle θ2 is set to 120°, the optical axis 62*a* of the light emitting element 62 and the optical axis 66*a* of the second light receiving element 66 are arranged so as to intersect at a scattering angle of, for example, 120°.

The first light receiving element 64 is sensitive to the light of the first wavelength λ1=700 nm emitted from the light emitting element 62. Therefore, when the light emitting element 62 emits light having the first wavelength λ1, the scattered light having a scattering angle θ1=30° due to the smoke flowing into the smoke detection unit 60 is received by the first light receiving element 64, and the first smoke detection value A1 is obtained.

Further, the second light receiving element 66 has sensitivity to light having a second wavelength λ2=450 nm emitted from the light emitting element 62. Therefore, when the light emitting element 62 emits light having the first wavelength λ1 and the second wavelength λ2, the scattered light having a scattering angle θ2=120° due to the smoke flowing into the smoke detection unit 60 is received by the second light receiving element 66, and the second smoke detection value A2 is obtained.

When the detector control unit 50 shown in FIG. 2 receives the batch AD conversion signal from the receiver 10 via the transmission unit 52, the detector control unit 50 instructs the light emitting drive unit 56 to drive the light emitting element 62. As a result, the light emitting element 62 emits white light including the first wavelength λ1 and the second wavelength λ2, and the backward scattered light having the first scattering angle θ1=30° by the first wavelength λ1 is received by the first light receiving element 64. Correspondingly, the detector control unit 50 AD-converts the first smoke detection value A1 output from the amplifier circuit 68 into digital data, reads it, and stores it in the memory.

At the same time, the backscattered light having a second scattering angle θ2=120° with the second wavelength λ2 is received by the second light receiving element 66. Therefore, the detector control unit 50 AD-converts the second smoke detection value A2 output from the amplifier circuit 70 in response to the light reception of the second light receiving element 66 into digital data, reads it, and stores it in the memory.

Subsequently, the detector control unit 50 compares the first smoke detection value A1 stored in the memory with the pre-alarm threshold value AP1*th* determined in advance corresponding to the set sensitivity of the photoelectric smoke detector 14, and the first smoke detection value A1. The detector control unit 50 determines that a fire is triggered when the first smoke detection value A1 is equal to or higher than the pre-alarm threshold value AP1*th*, and instructs the transmission unit 52 to transmit the fire interrupt signal to the receiver 10.

Here, as described above, the pre-alarm threshold value AP1*th* is set to, for example, AP1*th*=5%/m corresponding to the type 1 sensitivity upon the photoelectric smoke detector 14 corresponds to the type 2 sensitivity with the fire alarm threshold value A1*th* set to 10%/m. Further, the pre-alarm threshold value AP1*th* is set to, for example, APth=10%/m corresponding to the type 2 sensitivity upon the photoelectric smoke detector 14 corresponds to a type 3 sensitivity with the fire alarm threshold value A1*th* set to 15%/m.

(Identification of White Smoke Fire and Black Smoke Fire)

FIG. 4 is an explanatory diagram showing smoke detection values detected by the smoke detection unit structure of FIG. 2 and their ratios with respect to smoke when the cotton wick and kerosene are burned.

As shown in FIG. 4, the first smoke detection value A1 is a light receiving output of scattered light with the first wavelength λ1=700 nm and the first scattering angle θ1=30°. Further, the second smoke detection value A2 is a light receiving output by scattered light having the second wavelength λ2=450 nm and the second scattering angle θ2=120°.

The ratio R=A1/A2 of the first and second smoke detection values A1 and A2 measured by the combustion of the cotton wick and kerosene is R=8.0 for the cotton wick and R=2 for kerosene. Therefore, a remarkable difference appears in the ratio R of the cotton wick and kerosene, and it is possible to identify the type of smoke based on the ratio R.

Therefore, for example, Rth=5 is set as the ratio threshold Rth for identifying the type of smoke, when R≥5, it can be determined that white smoke is generated due to smoking, and when R<5, it can be determined that black smoke is generated due to combustion.

In the present embodiment, the receiver 10 shown in FIG. 1 collects the first and second smoke detection values A1 and A2 detected by the photoelectric smoke detector 14 that issued a fire. Therefore, the fire alarm control unit 48 calculates the ratio R=A1/A2 of the first and second smoke detection values A1 and A2, when R≥5, it is judged white smoke is generated due to smoking, and when R<5, it is judged black smoke is generated due to combustion.

Further, the fire alarm control unit 48 of the receiver 10 determines that it is the white smoke fire based on the first and second smoke detection values A1 and A2. Subsequently, the fire alarm control unit 48 determines that the fire is confirmed when the first smoke detection value A1 is equal to or greater than a fire alarm threshold value A1*th* corresponding to the smoke concentration of 10%/m of the type 2 sensitivity. As a result, the fire alarm containing information indicating the white smoke fire is output.

Similarly, the fire alarm control unit 48 of the receiver 10 determines that it is the black smoke fire based on the first and second smoke detection values A1 and A2. Subsequently, the fire alarm control unit 48 determines that the fire is confirmed when the second smoke detection value A2 is equal to or greater than a fire alarm threshold value A2*th* corresponding to the smoke concentration of 10%/m of the type 2 sensitivity. As a result, the fire alarm containing information indicating the black smoke fire is output.

[Sensor]

The sensor 18 shown in FIG. 1 includes a sensor unit for $CO_2$ detection, CO detection, flame detection or heat detection, except for the light emitting drive unit 56, smoke detection unit 60, and amplifier circuits 68, 70 in the photoelectric smoke detector 14 shown in FIG. 1. Other configurations and functions are the same circuit units as the detector control unit 50, transmission unit 52, and power supply unit 54 of the photoelectric smoke detector 14 in FIG. 2.

[Fire Alarm Equipment Fire Monitoring Control]

FIG. 5 is a flowchart showing the control operation in the receiver of FIG. 1, and the control operation is performed by the transmission control unit 46 and the fire alarm control unit 48 shown in FIG. 1. Further, FIG. 6 is a flowchart showing the control operation in the photoelectric smoke detector of FIG. 2, which is the control operation by the detector control unit 50. Further, the control of FIGS. 5 and 6 is characterized in that the receiver 10 side identifies the white smoke fire, the black smoke fire, or a non-fire factor.

(Control of receiver)

As shown in FIG. 5, the transmission control unit 46 of the receiver 10 performs polling response control for monitoring the state of whether the photoelectric smoke detector 14 and the sensor 18 are operating normally in step S1. In this polling response control, the transmission control unit 46 transmits the broadcast batch AD conversion signal in which all the photoelectric smoke detectors 14 and sensor 18 are specified at predetermined intervals to the signal line 12-1. As a result, the smoke detection values A1 and A2, which are analog signals output by the photoelectric smoke detector 14, are AD-converted into digital signals and stored, and the detection signal, which is the analog signal detected by the sensor 18, is AD-converted into digital signals and stored. Subsequently, the transmission control unit 46 transmits the polling signal in which the addresses of the photoelectric smoke detector 14 and the sensor 18 are sequentially specified, and receives the polling response signal transmitted by the photoelectric smoke detector 14 and the sensor 18 that have received the polling signal.

Subsequently, when the transmission control unit 46 determines the reception of the fire interrupt signal from the photoelectric smoke detector 14 that has been fire-activated in step S2, the transmission control unit 46 proceeds to step S3. In step S3, the transmission control unit 46 transmits the group search command signal and the intra-group search command signal, and searches for the address of the photoelectric smoke detector 14 that is activating due to the fire that transmitted the fire interrupt signal. signal.

Then, the transmission control unit 46 proceeds to step S4, shortens the cycle of the batch AD conversion signal, and transmits the polling signal specifying the address of the photoelectric smoke detector 14 that has transmitted the fire interrupt signal. As a result, the first and second smoke detection values A1 and A2 are repeatedly acquired from the photoelectric smoke detector 14 that is activated by fire, and transmitted to the fire alarm control unit 48 of the main CPU 26.

The fire alarm control unit 48 calculates the ratio R=A1/A2 of the first and second smoke detection values A1 and A2 in step S5, and compares it with the preset ratio threshold Rth=5 based on FIG. 4. If R≥5, the process proceeds to step S7 to determine the white smoke fire, and if R<5, the process proceeds to step S10 to determine the black smoke fire.

When the fire alarm control unit 48 determines that it is the white smoke fire, the process proceeds from step S7 to step S8, and transmits the polling signal specifying the address of sensor 18 installed in the same warning zone as the fire-activated photoelectric smoke detector 14 to get the detected value of the sensor 18. Subsequently, the fire alarm control unit 48 confirms the fire based on the detected value of the sensor 18 in step S9, and when the fire is confirmed, proceeds to step S13 to output the fire alarm.

Further, the fire alarm control unit 48 determined to be the black smoke fire proceeds from step S10 to step S11 and transmits the polling signal specifying the address of the sensor 18 installed in the same warning zone as the photoelectric smoke detector 14 that activated by the fire to get the detected value of the sensor 18. Subsequently, the fire alarm control unit 48 confirms the fire based on the detected value of the sensor 18 in step S12, and when the fire is confirmed, proceeds to step S13 to output the fire alarm.

The fire confirmation based on the detection value of the sensor 18 in steps S9 and S12 is determined by a unique confirmation judgment corresponding to the $CO_2$ sensor, CO sensor, flame sensor, and heat sensor provided as the sensor 18, and this point will be described later.

Subsequently, when the fire alarm control unit 48 determines the fire recovery in step S14, the fire alarm control unit 48 transmits a fire recovery signal to the photoelectric smoke detector 14 in step S15 to recover the fire, then returns to step S1 and repeats the control from step S1.

(Control of Photoelectric Smoke Detector)

As shown in FIG. 6, when the detector control unit 50 of the photoelectric smoke detector 14 shown in FIG. 2 determines the reception of the batch AD conversion signal from the receiver 10 in step S21, it proceeds to step S22 and drives the light emitting element 62 to emit light. As a result, the detector control unit 50 detects the smoke detection value A1 based on the light reception of the scattered light of the first wavelength $\lambda 1$ by the first scattering angle $\theta 1$, and also detects the smoke detection value A2 based on the light reception of the scattered light of the second wavelength $\lambda 2$ by the second scattering angle $\theta 1$, then the smoke detection values A1 and A2 are stored in the memory in step S23.

Subsequently, when the detector control unit 50 determines the reception of the polling signal for which the self-address is specified in step S24, the detector control unit 50 proceeds to step S25 and transmits the polling response signal indicating the detector status to the receiver 10 to notify the self status.

Subsequently, the detector control unit 50 proceeds to step S26, and when the first smoke detection value A1 determines that the alarm threshold value APth=5%/m or more corresponding to the type 2 sensitivity of the second type is determined, the fire is activated. Subsequently, the detector control unit 50 proceeds to step S27 and transmits the fire interrupt signal to the receiver 10. Subsequently, when the detector control unit 50 determines in step S28 that the group search command and the intra-group search command transmitted from the receiver 10 are received, the detector control unit 50 proceeds to step S29 and transmits a search response signal indicating the activation of the detector due to a fire. As a result, the receiver 10 acquires the address of the photoelectric smoke detector 14 activated by the fire.

Subsequently, the receiver 10 transmits the batch AD conversion signal and the subsequent polling signal specifying the detector address activated by the fire in a short cycle. Therefore, when the detector control unit 50 determines the reception of the batch AD conversion signal and the polling signal in step S30, the detector control unit 50 proceeds to step S31. In step S31, the detector control unit 50 detects the first and second smoke detection values A1 and A2 by the light emitting drive of the light emitting element 62 and stores them in the memory. Subsequently, the detector control unit 50 transmits the polling response signal including the smoke detection values A1 and A2 to the receiver 10 in step S32. As a result, the receiver 10 obtains the ratio R of the smoke detection values A1 and A2, identifies the white smoke fire or the black smoke fire, and controls to output the fire alarm.

Subsequently, the detector control unit 50 repeats the process from step S30 until it determines in step S33 that the fire recovery signal has been received from the receiver 10. Then, when the detector control unit 50 determines that the fire recovery signal has been received, it returns to step S1 and repeats the same control operation.

In the control of FIGS. 5 and 6, the receiver 10 side determines the white smoke fire and the black smoke fire, but the photoelectric smoke detector 14 side may determine the white smoke fire or the black smoke fire. In this case, the photoelectric smoke detector 14 transmits the fire signal including identification information of the white smoke fire or the black smoke fire to the receiver 10 to perform fire determination and fire alarm control.

[Specific Example of Fire Alarm Control]

Next, a specific example of fire alarm control will be described when the $CO_2$ sensor, the CO sensor, the flame sensor, and the heat sensor are used as the sensor 18 shown in FIG. 1.

FIG. 7 is an explanatory diagram showing fire judgment and interlocking control when the $CO_2$ sensor is installed in the warning zone of the photoelectric smoke detector, FIG. 7 (A) shows an outline of the equipment configuration, FIG. 7B shows fire judgment and interlocking control in a list format, and FIG. 7C shows another fire judgment and interlocking control in a list format. In addition, "o" of FIG. 7 (B) (C) indicates detection or activation, and "X" indicates non-detection or non-activation. Further, the automatic notification in the interlocking control of FIG. 7B includes an emergency broadcast by emergency announcement equipment. Further, the two-wavelength sensor and the additional sensor shown in FIG. 7B correspond to the input of the fire judgment, and the fire alarm and the interlocking control correspond to the output of the fire judgment.

As shown in FIG. 7A, the photoelectric smoke detector 14 is arranged in the warning zone Z11 and is connected to the signal line 12-1 from the receiver 10. Further, the $CO_2$ sensor 18-1 is arranged in the warning zone Z11 and is connected to the signal line 12-1 from the receiver 10 via the relay device 16.

The warning zone Z11 is a living room such as a bedroom, and bedding and furniture such as a bed 72, a sofa 74, and a bookshelf 76 are arranged. Further, since the resident smokes a cigarette, an ashtray 78 is placed on the table near the bed 72.

When the resident smokes the cigarette in the living room of the warning zone Z11, as shown in mode A of FIG. 7B, when the pre-alarm threshold AP1*th* or higher is reached based on smoke detection by the photoelectric smoke detector 14, the fire alarm control unit 48 of the receiver 10 Judges the white smoke fire. However, since $CO_2$ is not detected by the $CO_2$ sensor 18-1, it is judged that it is due to some non-fire factor (non-fire factor due to smoking), and fire monitoring is continued without outputting the fire alarm, in addition, interlocking control is not performed.

On the other hand, in the living room of warning zone Z11, it is assumed that the bedding piled up due to mismanagement of sleeping cigarettes is ignited and smoked, and white smoke and $CO_2$ are generated. In this case, as shown in mode B of FIG. 7B, the fire alarm control unit 48 of the receiver 10 determines the white smoke fire when the pre-alarm threshold value AP1*th* or higher is reached based on the smoke detection by the photoelectric smoke detector 14. At the same time, $CO_2$ detection by the $CO_2$ sensor 18-1 can be obtained. Therefore, the fire alarm control unit 48 confirms the fire and outputs the fire alarm.

Even if the bedding is not ignited, a large amount of smoke that is not at a normal level is generated on the ashtray 78, and the smoke detection value A1 by the photoelectric smoke detector 14, for example, exceeds the predetermined fire alarm threshold A1*th* (A1*th* is, for example, 10%/m corresponding to the type 2 sensitivity higher than the pre-alarm threshold AP1*th*, which is the alarm threshold of 5%/m corresponding to the type 1 sensitivity). (Alternatively, it is assumed that the smoke detection value A1 exceeds the fire alarm threshold value A1*th* and continues for a predetermined period of time). In this case, as shown in mode C of FIG. 7C, an abnormality (or fire) may be determined and an abnormality alarm (or a second fire alarm) may be issued.

Further, the fire alarm control unit 48 of the receiver 10 activates the exhaust device 22 corresponding to the warning zone Z11 shown in FIG. 1 to exhaust the smoke based on the correspondence between the living room which is the type of the warning zone Z11 stored in advance and the interlocking control. At the same time, the fire alarm control unit 48 activates the automatic notification device 102 to automatically notify the fire department and the guard room.

In this case, since there is no sudden spread of fire in the living room such as the bedroom (because the risk of fire is low), interlocking control of fire extinguishing equipment 106 should not be performed. As a result, the resident's response to initial fire extinguishing is prioritized, and extra water damage caused by fire extinguishing can be prevented.

(Fire Judgment and Interlocking Control by White Smoke Fire and CO Detection)

FIG. 8 is an explanatory diagram showing fire judgment and interlocking control when the CO sensor is installed in the warning zone of the photoelectric smoke detector. FIG. 8 (A) shows an outline of the equipment configuration, FIG. 8 (B) shows the fire judgment and the interlocking control in a list format, and FIG. 8 (C) shows another fire judgment and the interlocking control in a list format. In addition, "o" of FIG. 8 (B) (C) indicates detection or activation, and "×" indicates non-detection or non-activation. Further, the automatic notification in the interlocking control shown in FIG. 8B includes the emergency broadcast by emergency announcement equipment.

As shown in FIG. 8A, the photoelectric smoke detector 14 is arranged in the warning zone Z12 and is connected to the signal line 12-1 from the receiver 10. Further, the CO sensor 18-2 is arranged and connected to the signal line 12-1 from the receiver 10 via the relay device 16.

The warning zone Z12 is a living room or the like, and furniture such as a sofa 74 is arranged, a stove 80 is installed as a heating appliance, and an ashtray 78 is also arranged.

In such a living room of warning zone Z12, the amount of CO generated is small, and as shown in mode A of FIG. 8 (B), it is less than the sensitivity of CO sensor 18-2, and CO is not detected.

On the other hand, it is assumed that the stove 80 is heated in the living room of the warning zone Z12, and the sofa 74 in the vicinity is ignited and smoked to generate white smoke and CO. In this case, as shown in mode B of FIG. 8B, the fire alarm control unit 48 of the receiver 10 determines the white smoke fire based on the smoke detection by the photoelectric smoke detector 14. At the same time, the fire alarm control unit 48 confirms the fire by obtaining CO detection by the CO sensor 18-2 and outputs the fire alarm.

Further, the fire alarm control unit 48 of the receiver 10 activates the exhaust device 22 of FIG. 1 corresponding to the warning zone Z12 to exhaust the smoke based on the correspondence between the living room which is the type of the warning zone Z12 stored in advance and the interlocking control. At the same time, the fire alarm control unit 48 activates the automatic notification device 102 to automatically notify the fire department and the guard room.

In this case, since there is no sudden expansion of the fire in the living room or the like (because the risk of fire is low), the interlocking control of the fire extinguishing equipment 106 is not performed. As a result, the resident's response to initial fire extinguishing is prioritized, and extra water damage caused by fire extinguishing is prevented.

Further, even when furniture or the like is not ignited, a large amount of smoke that is not at a normal level is generated on the ashtray 78 or the like, and for example, the smoke detection value A1 by the photoelectric smoke detector 14 exceeds the predetermined fire alarm threshold value A1*th* (A1*th* is, for example, the fire alarm threshold A1*th*=10%/m corresponding to the type 2 sensitivity higher than the pre-alarm threshold AP1*th*, which is the alarm threshold of 5%/m corresponding to the type 1 sensitivity). (Alternatively, it is assumed that the smoke detection value A1 exceeds the fire alarm threshold A1*th* and continues for a predetermined period of time). In this case, as shown in mode C of FIG. 8C, the abnormality (or fire) may be determined and an abnormality alarm (or the second fire alarm) may be issued.

(Fire Judgment and Interlocking Control by Black Smoke Fire and Flame Detection)

FIG. 9 is an explanatory diagram showing fire judgment and interlocking control when the flame sensor is installed in the warning zone of the photoelectric smoke detector. FIG. 9A shows an outline of the equipment configuration, FIG. 9B shows fire judgment and interlocking control in a list format, and FIG. 9C shows another fire judgment and interlocking control in a list format. In addition, "o" of FIG. 9 (B) (C) indicates detection or activation, and "×" indicates non-detection or non-activation. Further, the automatic notification in the interlocking control of FIG. 9B includes the emergency broadcast by emergency announcement equipment.

As shown in FIG. 9A, the photoelectric smoke detector 14 is arranged in the warning zone Z13 and is connected to the signal line 12-1 from the receiver 10. Further, the flame sensor 18-3 is arranged in the warning zone Z13 and is connected to the signal line 12-1 from the receiver 10 via the relay device 16. The warning zone Z13 is a smoking room, and a sofa 74 and an ashtray 78 are arranged.

In such a smoking room in warning zone Z13, white smoke generated by smoking is constantly generated, and a small flame generated by a lighter is also generated. Therefore, as shown in FIG. 9B, the fire alarm control unit 48 of the receiver 10 determines the white smoke fire based on the smoke detection by the photoelectric smoke detector 14. However, since the flame detection by the flame sensor 18-3 cannot be obtained, the fire alarm control unit 48 does not confirm the fire and continues the fire monitoring without outputting the fire alarm.

On the other hand, in the smoking room of warning zone Z13, it is assumed that a fire is transferred from the ashtray 78 to the nearby sofa 74 due to the mismanagement of cigarettes, and black smoke is generated together with the flame. In this case, as shown in FIG. 9B, the fire alarm control unit 48 of the receiver 10 determines the black smoke fire based on the smoke detection by the photoelectric smoke detector 14. At the same time, the fire alarm control unit 48 confirms the fire by obtaining the flame detection by the flame sensor 18-3 and outputs the fire alarm.

Further, the fire alarm control unit 48 of the receiver 10 activates the exhaust device 22 of FIG. 1 corresponding to the warning zone Z13 to exhaust the smoke based on the correspondence relationship between the smoking room which is the type of the warning zone Z13 and the interlocking control stored in advance. At the same time, the fire alarm control unit 48 activates the automatic notification device 102 to automatically notify the fire department and the guard room.

In this case, since the fire in the smoking room does not spread rapidly (because the risk of fire is low), the fire alarm control unit 48 does not perform interlocking control of the fire extinguishing equipment 106. As a result, the resident's response to initial fire extinguishing is prioritized, and extra water damage caused by fire extinguishing is prevented.

Further, even when the sofa or the like is not ignited, a large amount of smoke that is not at a normal level is generated on the ashtray 78 or the like, and for example, the smoke detection value A1 by the photoelectric smoke detector 14 exceeds the predetermined fire alarm threshold value A1*th* (A1*th* is, for example, the fire alarm threshold A1*th*=10%/m corresponding to the type 2 sensitivity higher than the pre-alarm threshold AP1*th*, which is the alarm threshold of 5%/m corresponding to the type 1 sensitivity). (Alternatively, it is assumed that the smoke detection value A1 exceeds the fire alarm threshold A1*th* and continues for a predetermined period). In this case, as shown in mode C of FIG. 9C, the fire alarm control unit 48 may determine that there is the abnormality (or fire) and issue an abnormality alarm (or the second fire alarm).

(Fire Judgment and Interlocking Control by Black Smoke Fire and Heat Detection)

FIG. 10 is an explanatory diagram showing fire judgment and interlocking control when the heat sensor is installed in the warning zone of the photoelectric smoke detector. FIG. 10 (A) shows the outline of the equipment configuration, and FIG. 10 (B) shows the fire judgment and the interlocking control in a list format. In addition, "o" of FIG. 10B indicates detection or activation, and "×" indicates non-detection or non-activation. Further, the automatic notification in the interlocking control of FIG. 10B includes the emergency broadcast by emergency announcement equipment.

As shown in FIG. 10A, the photoelectric smoke detector 14 is arranged in the warning zone Z14 and is connected to the signal line 12-1 from the receiver 10. Further, the heat sensor 18-4 is arranged in the warning zone Z14 and is connected to the signal line 12-1 from the receiver 10 via the relay device 16.

The warning zone Z14 is a dangerous goods warehouse, in which a fuel tank 82 for storing liquid fuel is installed, and a pipe from the fuel tank 82 passes near a switchboard 84.

In such a dangerous goods warehouse in warning zone Z14, it is assumed that liquid fuel leaks from the piping of the fuel tank 82 and ignites from the electric system of the switchboard 84, causing a fire to spread. In this case, the combustion material is only liquid fuel, and black smoke is generated together with the flame.

At this time, the fire alarm control unit 48 of the receiver 10 determines the black smoke fire based on the smoke detection by the photoelectric smoke detector 14, as shown in the mode A of FIG. 10B, at the initial stage of the fire. In this case, as shown in mode B of FIG. 10B, the fire alarm control unit 48 confirms the fire by immediately obtaining the heat detection by the heat sensor 18-4, and outputs the fire alarm.

Further, the fire alarm control unit 48 of the receiver 10 identifies the exhaust device 22 and the fire proof door 24 corresponding to the warning zone Z14 based on the correspondence between the dangerous goods warehouse having the fuel tank and the interlocking control, which is the type of the warning zone Z14 stored in advance. As a result, the fire alarm control unit 48 activates the exhaust device 22 to exhaust the smoke and activates the fire proof door 24 to close it. Further, the fire alarm control unit 48 activates the automatic notification device 102 to automatically notify the fire department and the guard room, and further activates the fire extinguishing equipment 106 to spray a fire extinguishing agent or the like to automatically extinguish the fire.

(Fire Judgment and Interlocking Control by Black Smoke Fire, Flame Detection and Heat Detection)

FIG. 11 is an explanatory diagram showing fire judgment and interlocking control when the flame sensor and the heat sensor are installed in the warning zone of the photoelectric smoke detector. FIG. 11A shows an outline of the equipment configuration, and FIG. 11B shows fire judgment and interlocking control in a list format. In addition, "○" of FIG. 11B indicates detection or activation, and "×" indicates non-detection or non-activation. Further, the automatic notification in the interlocking control of FIG. 11B includes the emergency broadcast by emergency announcement equipment.

As shown in FIG. 11A, the photoelectric smoke detector 14 is arranged in the warning zone Z15 and is connected to the signal line 12-1 from the receiver 10. Further, the flame sensor 18-3 and the heat sensor 18-4 are arranged and connected to the signal line 12-1 from the receiver 10 via the relay device 16, respectively.

The warning zone Z15 is, for example, a factory where a welding machine 86 is used, and a fuel tank 82 for storing liquid fuel is installed.

In such a factory of warning zone Z15, a small amount of flame and white smoke are constantly generated due to the use of the welding machine 86 or the like. Therefore, the fire alarm control unit 48 of the receiver 10 determines the white smoke fire based on the smoke detection by the photoelectric smoke detector 14, as shown in the mode A of FIG. 11 (B). However, since the fire alarm control unit 48 cannot obtain both flame detection by the flame sensor 18-3 and heat detection by the heat sensor 18-4, the fire is not confirmed even if the white smoke fire is judged. As a result, the fire alarm control unit 48 continues fire monitoring without outputting the fire alarm.

On the other hand, if a spark from the use of the welding machine 86 ignites the nearby fuel tank 82, the liquid fuel burns with a flame and black smoke. At this time, the fire alarm control unit 48 of the receiver 10 determines the black smoke fire based on the smoke detection by the photoelectric smoke detector 14, as shown in the mode B of FIG. 11 (B). As a result, the fire alarm control unit 48 confirms the fire by obtaining both the flame detection by the flame sensor 18-3 and the heat detection by the heat sensor 18-4, and outputs the fire alarm.

Further, the fire alarm control unit 48 of the receiver 10 identifies the exhaust device 22 and the fire proof door 24 based on the correspondence between the factory where the welding machine 86, which is the type of the warning zone Z15, is stored in advance and the interlocking control. Then, the fire alarm control unit 48 activates the exhaust device 22 of FIG. 1 corresponding to the warning zone Z15 to exhaust the smoke and close the fire proof door 24. Further, the fire alarm control unit 48 activates the automatic notification device 102 to automatically notify the fire department and the guard room, and further activates the fire extinguishing equipment 106 to spray a fire extinguishing agent or the like to automatically extinguish the fire.

The type of warning zone and the arrangement of the $CO_2$ sensor, CO sensor, flame sensor, and heat sensor corresponding to the type of warning zone are not limited to the above embodiments. In another embodiment, one or a plurality of different types of sensors are installed according to the type of warning zone and the degree of risk to fire, and fire confirmation and interlocking control are performed when the white smoke fire or the black smoke fire is determined.

Further, the $CO_2$ sensor 18-1, CO sensor 18-2, flame sensor 18-3, and heat sensor 18-4 are not installed separately, but may be configured as a multi-sensor built in the photoelectric smoke detector 14, and each sensor information is processed collectively. In this case, the smoke detection value of the photoelectric smoke detector 14 and the information of each sensor may be separately transmitted to the receiver 10 and the fire identification may be performed by the receiver 10. Alternatively, the same processing may be performed inside the photoelectric smoke detector 14, and the determination value for each level to be interlocked and controlled may be transmitted to the receiver 10.

In this case, the details of the fire alarm and interlocking control, which are the outputs when a fire is determined based on the inputs of white smoke fire, black smoke fire, and sensor detection other than smoke by the multi-sensor, are the same as those shown in the list format in FIGS. 7 to 11.

[Modification of the Present Invention]

(Photoelectric Smoke Detector)

In the above embodiment, as shown in FIG. 4, the photoelectric smoke detector having the smoke detection unit structure including one light emitting element and two light emitting elements is taken as an example. However, it is not limited to this. Another embodiment is a photoelectric smoke detector having a smoke detection unit structure capable of obtaining first and second smoke detection values A1 and A2 by setting different wavelengths and scattering angles, and is shown in, for example, Patent Document 2. It may be a photoelectric smoke detector having a smoke detection unit structure including two light emitting elements and one light emitting element.

Further, in the above embodiment, when the photoelectric smoke detector receives the batch AD conversion signal from the receiver, the photoelectric smoke detector detects the first and second smoke detection values A1 and A2 by the light emitting drive of the light emitting element. However, it is not limited to this. In another embodiment, the photoelectric smoke detector itself intermittently drives the light emitting element to emit light at a predetermined cycle to detect the first and second smoke detection values A1 and A2, regardless of the instruction from the receiver.

(P-Type Fire Alarm Equipment)

The above embodiment exemplifies the R-type fire alarm equipment that monitors a fire by transmitting and receiving the signal between the receiver and the addressed photoelectric smoke detector. However, it is not limited to this. Another embodiment may be a P-type fire alarm equipment. The P-type fire alarm equipment transmits a white smoke fire signal, a black smoke fire signal, or a non-fire factor signal to the receiver based on the fire operation of the photoelectric smoke detector without receiving an instruction from the receiver. Based on this, the receiver outputs a white smoke fire alarm, a black smoke fire alarm, or a non-fire alarm warning.

Such a P-type fire alarm equipment transmits the white smoke fire signal, the black smoke fire signal, or the non-fire factor signal to the receiver by passing an alarm current through the signal line from the receiver by a photoelectric smoke detector. In this case, the photoelectric smoke detector superimposes a unique frequency signal or pulse code signal on the alarm current in order to identify the white smoke fire signal, the black smoke fire signal, or the non-fire factor signal. Therefore, the receiver can identify the smoke fire signal, the black smoke fire signal or the non-fire factor signal and output the white smoke fire alarm, the black smoke fire alarm, or the non-fire factor caution alarm.

Further, the interlocking control of the control equipment such as the area sound device, the exhaust device, and the fire extinguishing device in the P-type fire alarm equipment is the P-type interlocking control performed for each line.

In the above embodiment, a wired system in which a photoelectric smoke detector is connected to a signal line from the receiver is taken as an example, but a wireless system in which the receiver and the photoelectric smoke detector are connected by a wireless line may also be used.

(Judgment by Comparison)

In the above embodiment, for example, as a magnitude comparison between the ratio R and the ratio threshold value Rth, the case of $R \geq Rth$ and the case of $R < Rth$ are shown. However, the magnitude is not limited to this, and the magnitude comparison between the ratio R and the ratio threshold value Rth may be performed when $R > Rth$ and $R \leq Rth$.

Further, in order to eliminate the influence of the slight fluctuation of the value of R, it is possible to give a delay to the determination of Rth or to give a hysteresis. Hysteresis means, for example, that when the ratio becomes larger than the threshold value Rth and the white smoke is judged, the judgment of the white smoke is not changed until the ratio becomes smaller than the threshold value ($Rth-\Delta Rth$). Here, the threshold value ($Rth-\Delta Rth$) is obtained by subtracting a predetermined value ARth for removing the influence of minute fluctuations from the threshold value Rth. The same applies to the magnitude comparison of other values.

(Other)

Further, the present invention includes appropriate modifications that do not impair its purpose and advantages, and is not limited by the numerical values shown in the above embodiments.

EXPLANATION OF SYMBOLS

10: receiver
12,12-1~12-3: signal line
14: photoelectric smoke detector
16: relay device
18: sensor
18-1: $CO_2$ sensor
18-2: CO sensor
18-3: flame sensor
18-4: heat sensor
29: area sound device
22: exhaust device
24: fire proof door

26: main CPU
28-1~28-3: sub CPU substrate
32: sub CPU
32,52: transmission unit
34: serial transmission bus
36: display
38: indicator unit
40: operation unit
42: sound alarm unit
44: alarm transfer unit
46: transmission control unit
48: fire alarm control unit
50: detector control unit
54: power supply unit
56: light emitting drive unit
60: smoke detection unit
62: light emitting element
62*a*, 64*a*, 66*a*: optical axis
64: first light receiving element
66: second light receiving element
68,70: circuit amplifier circuit
100: fire alarm equipment
102: automatic notification device
104: emergency announcement equipment
106: fire extinguishing equipment

The invention claimed is:

1. A fire alarm equipment for monitoring and alerting of fires in a warning area, the fire alarm equipment comprising:

a photoelectric smoke detector that connects to a receiver and sends a fire signal containing identification information of the smoke that occurred in a predetermined warning zone;

a sensor that is installed in the same warning zone as the photoelectric smoke detector and detects a change of a physical phenomenon other than smoke associated with a fire; and a fire alarm control unit provided in the receiver to determine the presence of a fire and output a fire alarm based on the identification information of the smoke by the fire signal from the photoelectric smoke detector and the detection signal from the sensor, wherein the fire alarm control unit of the receiver stores in advance a correspondence between a type of the warning zone and an interlocking control, and upon determining that a fire is present, performs the interlocking control corresponding to the type of the warning zone.

2. A fire alarm equipment for monitoring and alerting of fires in a warning area, the fire alarm equipment comprising:

a photoelectric smoke detector that connects to a receiver and sends a fire signal containing identification information of the smoke that occurred in a predetermined warning zone;

a sensor that is installed in the same warning zone as the photoelectric smoke detector and detects a change of a physical phenomenon other than smoke associated with a fire; and a fire alarm control unit provided in the receiver to determine the presence of a fire and output a fire alarm based on the identification information of the smoke by the fire signal from the photoelectric smoke detector and the detection signal from the sensor, wherein the photoelectric smoke detector comprises:

a smoke detection unit that detects a first smoke detection value by receiving a light of a first wavelength and scattered light of the smoke by setting a first scattering angle, and detects a second smoke detection value by receiving a light of a second wavelength different from the light of the first wavelength and scattered light of the smoke by setting a second scattering angle different from the first scattering angle; and a detector control unit that identifies smoke based on the first smoke detection value and the second smoke detection value detected by the smoke detection unit, and transmits a fire signal containing the identification information of the smoke to the receiver.

3. A fire alarm equipment for monitoring and alerting of fires in a warning area, the fire alarm equipment comprising:

a photoelectric smoke detector that connects to a receiver and sends a fire signal containing identification information of the smoke that occurred in a predetermined warning zone;

a sensor that is installed in the same warning zone as the photoelectric smoke detector and detects a change of a physical phenomenon other than smoke associated with a fire; and a fire alarm control unit provided in the receiver to determine the presence of a fire and output a fire alarm based on the identification information of the smoke by the fire signal from the photoelectric smoke detector and the detection signal from the sensor, wherein the photoelectric smoke detector comprises:

a smoke detection unit that detects a first smoke detection value by receiving a light of a first wavelength and scattered light of the smoke by setting a first scattering angle, and detects a second smoke detection value by receiving a light of a second wavelength different from the light of the first wavelength and scattered light of the smoke by setting a second scattering angle different from the first scattering angle, and a detector control unit that transmits a smoke detection value detection signal including the first smoke detection value and the second smoke detection value detected by the smoke detection unit to the receiver, and wherein the fire alarm control unit of the receiver identifies smoke based on the first smoke detection value and the second smoke detection value received from the photoelectric smoke detector.

4. The fire alarm equipment according to claim 1, wherein the sensor is at least one of a $CO_2$ sensor that detects $CO_2$ generated by a fire, a CO sensor that detects CO generated by a fire, a flame sensor that detects a flame generated by a fire, and a heat sensor that detects a heat generated by a fire, and wherein the fire alarm control unit of the receiver outputs the fire alarm upon determining the identification information of the smoke and a detection value detected by the at least one of the $CO_2$ sensor, the CO sensor, the flame sensor, and the heat sensor.

5. The fire alarm equipment according to claim 2, wherein the sensor is at least one of a $CO_2$ sensor that detects $CO_2$ generated by a fire, a CO sensor that detects CO generated by a fire, a flame sensor that detects a flame generated by a fire, and a heat sensor that detects a heat generated by a fire, and wherein the fire alarm control unit of the receiver outputs the fire alarm upon determining the identification information of the smoke and a detection value detected by the at least one of the $CO_2$ sensor, the CO sensor, the flame sensor, and the heat sensor.

6. The fire alarm equipment according to claim 3, wherein the sensor is at least one of a $CO_2$ sensor that detects $CO_2$ generated by a fire, a CO sensor that detects CO generated by a fire, a flame sensor that detects a flame generated by a fire, and a heat sensor that detects a heat generated by a fire, and wherein the fire alarm control unit of the receiver outputs the fire alarm upon determining the identification information of the smoke and a detection value detected by the at least one of the $CO_2$ sensor, the CO sensor, the flame sensor, and the heat sensor.

* * * * *